US011759757B1

(12) United States Patent
Lin

(10) Patent No.: US 11,759,757 B1
(45) Date of Patent: Sep. 19, 2023

(54) DEVICE AND APPARATUS FOR AGITATION OF LIQUID

(71) Applicant: Chun-Ming Lin, Hsinchu County (TW)

(72) Inventor: Chun-Ming Lin, Hsinchu County (TW)

( * ) Notice: Subject to any disclaimer, the term of this patent is extended or adjusted under 35 U.S.C. 154(b) by 0 days.

(21) Appl. No.: 18/066,055

(22) Filed: Dec. 14, 2022

(51) Int. Cl.

| | |
|---|---|
| ***B01F 31/31*** | (2022.01) |
| ***B01F 33/451*** | (2022.01) |
| ***B01F 31/20*** | (2022.01) |
| *C25D 21/10* | (2006.01) |
| *C23C 18/16* | (2006.01) |
| *B01F 101/00* | (2022.01) |

(52) U.S. Cl.
CPC ..... *B01F 33/451* (2022.01); *B01F 31/27* (2022.01); *B01F 31/31* (2022.01); *B01F 2101/2204* (2022.01); *C23C 18/1669* (2013.01); *C25D 21/10* (2013.01)

(58) Field of Classification Search
CPC ..... B01F 31/27; B01F 31/31
USPC ..... 366/114, 127
See application file for complete search history.

(56) References Cited

U.S. PATENT DOCUMENTS

| | | | | |
|---|---|---|---|---|
| 1,138,457 | A * | 5/1915 | Dahlmeyer | B22D 18/04 164/203 |
| 8,824,723 | B2 | 9/2014 | Lin | |
| 2003/0107946 | A1 * | 6/2003 | Cosby | B01F 31/31 366/127 |

FOREIGN PATENT DOCUMENTS

| | | | |
|---|---|---|---|
| CN | 103220606 | B | 7/2013 |
| TW | I451769 | B | 7/2013 |
| TW | I572211 | B | 2/2016 |
| TW | I625766 | B | 11/2016 |

* cited by examiner

*Primary Examiner* — David L Sorkin
(74) *Attorney, Agent, or Firm* — WPAT, P.C., INTELLECTUAL PROPERTY ATTORNEYS; Anthony King

(57) ABSTRACT

The present disclosure provides a device for assisting agitation of liquid. The device includes a frame having a bottom and a sidewall forming an angle with the bottom; a first flexible film attached to the frame at a periphery portion of the first flexible film; a first magnetic field generator at the sidewall of the frame and adjacent to the periphery portion of the first flexible film; and a second magnetic field generator at the bottom of the frame, wherein the first magnetic field generator and the second magnetic field generator are configured to provide a magnetic field parallel to at least a portion of the first flexible film, and wherein a portion of the frame and the first flexible film are configured to be in contact with the solution.

20 Claims, 28 Drawing Sheets

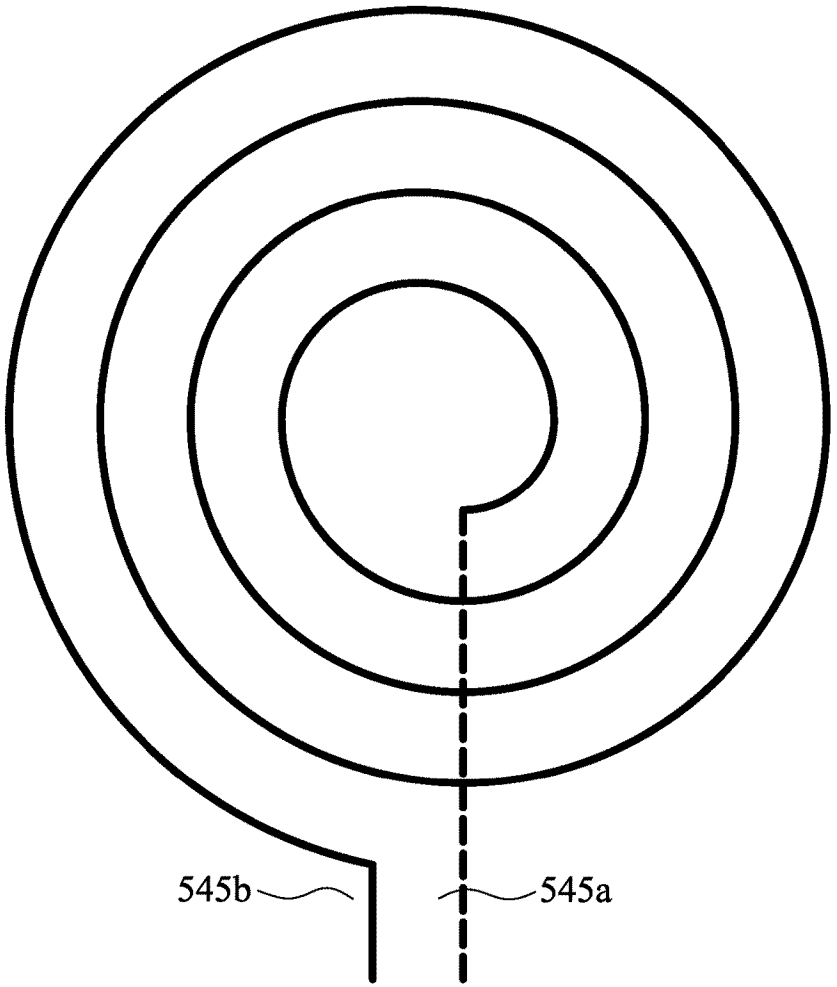
FIG. 9A
541
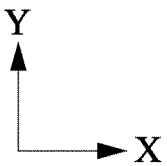

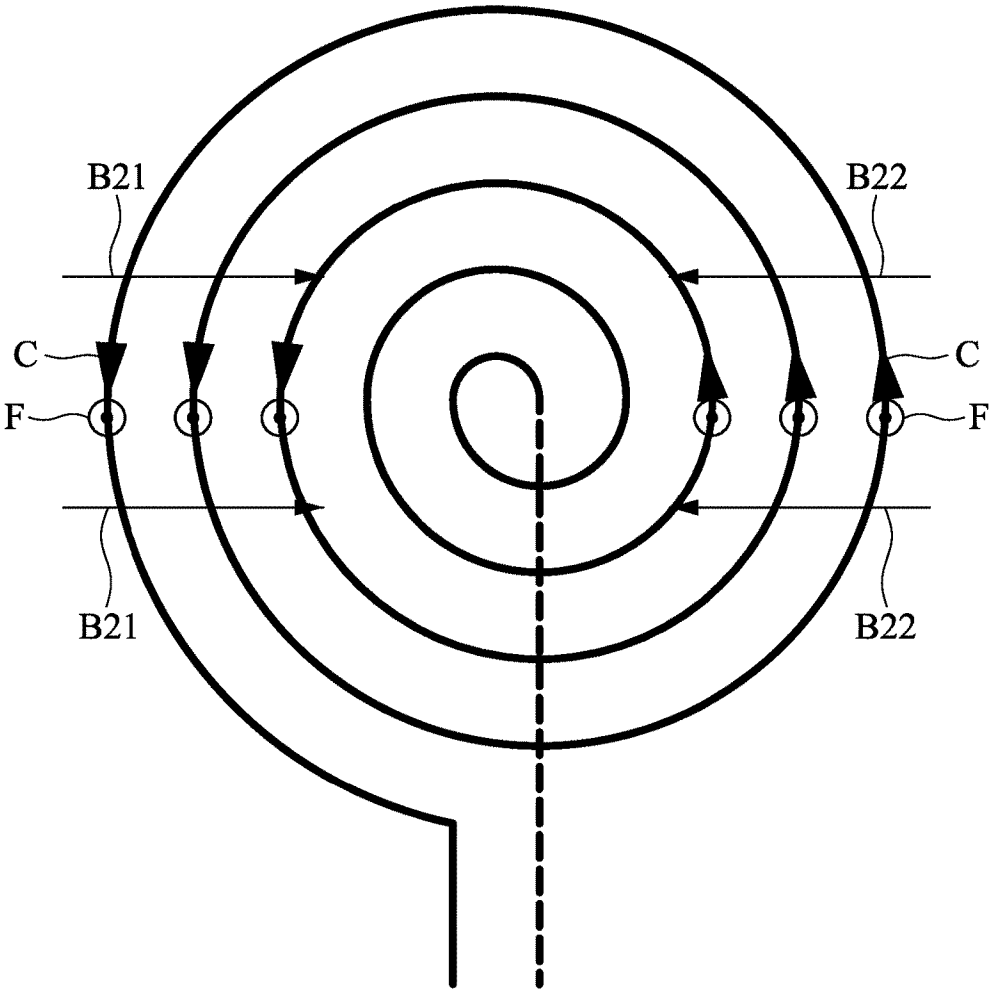
FIG. 14
541
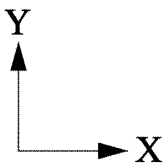

DEVICE AND APPARATUS FOR AGITATION OF LIQUID

CROSS REFERENCE TO RELATED APPLICATIONS

The specification and drawings set forth in U.S. application Ser. No. 17/697,937, filed on Mar. 18, 2022 and entitled "CONDUCTIVE STRUCTURE INCLUDING COPPER-PHOSPHOROUS ALLOY AND A METHOD OF MANUFACTURING CONDUCTIVE STRUCTURE", and U.S. application Ser. No. 17/815,613, filed on Jul. 28, 2022 and entitled "INTERCONNECT STRUCTURE AND MANUFACTURING METHOD FOR THE SAME", are incorporated herein by reference in their entirety.

BACKGROUND

The integrated circuit (IC) industry has experienced exponential growth. Technological advances in IC materials and design have produced generations of ICs where each generation has smaller and more complex circuits than the previous generation. In the course of IC evolution, functional density (i.e., number of interconnected devices per chip area) has generally increased while geometry size (i.e., size of a smallest component (or line) that can be created using a fabrication process) has decreased. This scaling down process generally provides benefits by increasing production efficiency. However, such scaling down process has also increased the complexity of processing and fabricating ICs. For these advances to be realized, improvements in IC processing and manufacturing equipment are required.

Liquid phase deposition, including electroplating and auto-catalytic plating (i.e., electroless plating) is one of the crucial process for IC manufacturing. Liquid phase deposition includes deposition of metal (e.g. copper) onto a substrate (e.g. a silicon wafer) or a printed circuit board. For electroplating, seed layer is formed on the substrate areas to be deposited. Cathode terminal of electric power supply is connected to the seed layer, and anode terminal is placed at a distance from substrate. The substrate and the terminals are immersed into an electroplating solution. As a result, metal layer is deposited on seed layer from metal ions supplied by salts in the electroplating solution and by anode terminal. On the other hand, electroless plating is also one of the most important metallization technologies in the printed circuit board industry. In recent years high density printed circuit boards such as those with microvias and through-holes are processed by electroless plating due to more beneficial fluid dynamics allowing metallization chemicals to reach the bottom of microvias, especially those microvias with high aspect ratios of 1:1 and higher.

BRIEF DESCRIPTION OF THE DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

FIGS. 9A and 9B are schematic views showing configurations of a conductive coil of a device for assisting in liquid phase deposition in accordance with some embodiments of the present disclosure.

FIG. 14 is a schematic diagram of a conductive coil illustrating forces resulting from an interaction of a current flowing through a conductive coil with magnetic fields of the device of FIG. 13.

DETAILED DESCRIPTION

Figure 1:
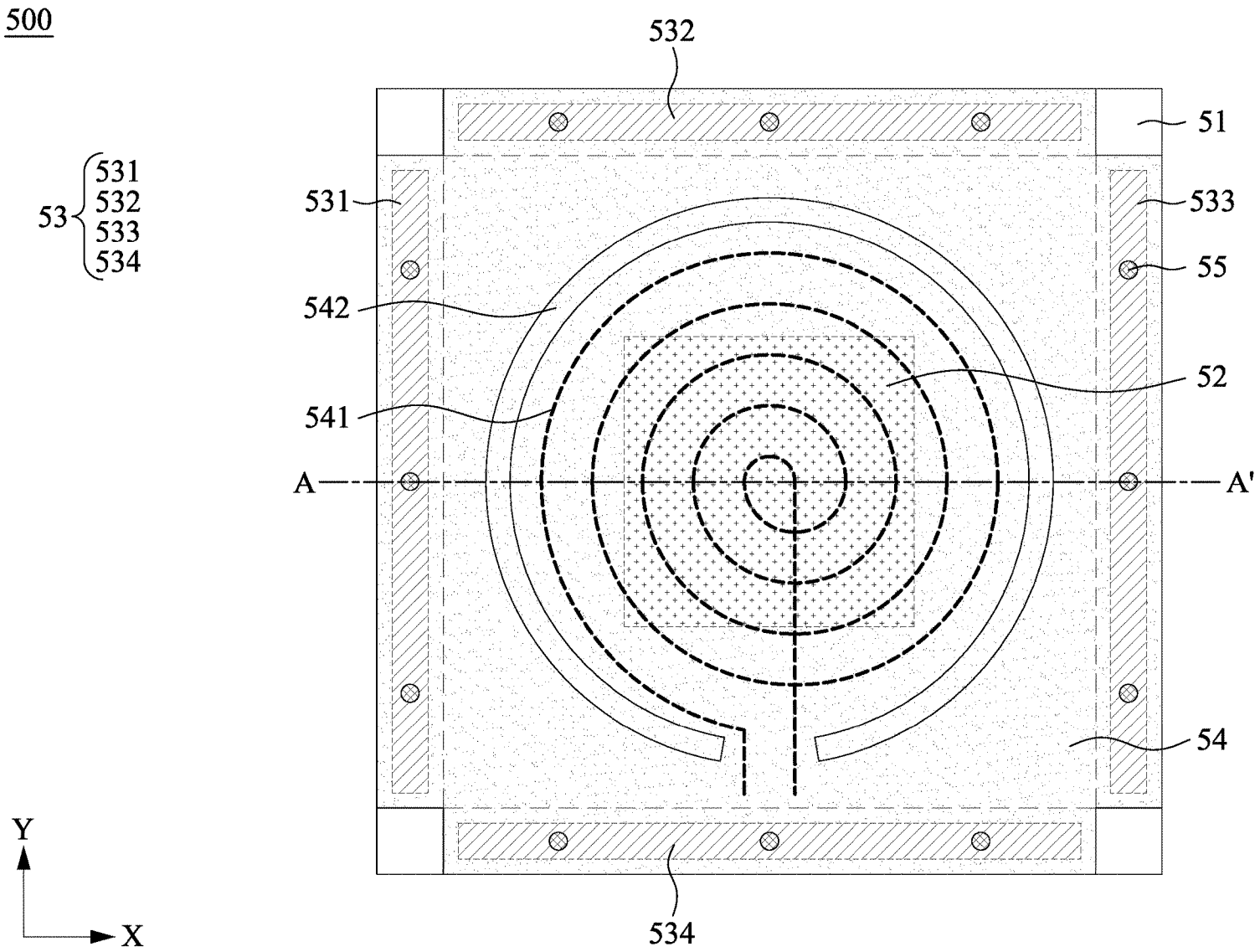
FIG. 1 is a schematic top-view diagram of a device for assisting in liquid phase deposition in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in the respective testing measurements. Also, as used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, two numerical values can be deemed to be "substantially" the same or equal if a difference between the values is less than or equal to ±10% of an average of the values, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" parallel can refer to a range of angular variation relative to 0° that is less than or equal to ±10°, such as less than or equal to ±50, less than or equal to ±4°, less than or equal to ±3°, less than or equal to ±2°, less than or equal to ±1°, less than or equal to ±0.5°, less than or equal to ±0.1°, or less than or equal to ±0.05°. For example, "substantially" perpendicular can refer to a range of angular variation relative to 90° that is less than or equal to ±10°, such as less than or equal to ±50, less than or equal to ±4°, less than or equal to ±3°, less than or equal to ±2°, less than or equal to ±1°, less than or equal to ±0.5°, less than or equal to ±0.1°, or less than or equal to ±0.05°. Accordingly, unless indicated to the contrary, the numerical parameters set forth in the present disclosure and attached claims are approximations that can vary as desired. At the very least, each numerical parameter should at least be construed in light of the number of reported significant digits and by applying ordinary rounding techniques. Ranges can be expressed herein as from one endpoint to another endpoint or between two endpoints. All ranges disclosed herein are inclusive of the endpoints, unless specified otherwise.

Plating is a common technique utilized in conventional approaches for fabricating semiconductor devices or printed circuit boards (PCB); however, such technique often faces issues of uneven distribution across a wafer causing defects in advanced technology nodes. Electroless plating and electroplating are two types of plating techniques commonly used in fabrication of a thin film on a workpiece. Electroless plating (also referred to as chemical plating or autocatalytic plating) is a type of technique that creates metal or metal-containing alloy coatings on various materials by autocatalytic chemical reduction of metal cations in a liquid bath, wherein a workpiece (e.g., a wafer or a substrate) to be plated is immersed in a reducing agent that, when catalyzed by certain materials, changes metal ions to metal that forms a coating on the workpiece. Generally, advantages of the electroless plating technique include compatibility and product quality; however, processing duration of the electroless plating is greater than that of electroplating for a same thickness of a film. In some cases, the electroless plating technique can be applied to both conductive workpieces and non-conductive workpieces, including workpieces having smaller sizes or smaller surface areas. In contrast, electroplating is a technique for forming metal coatings on various materials by an externally-generated electric current. Advantages of the electroplating technique include greater efficiency and throughput; however, electroplating may provide less compatibility and lower product quality compared to the electroless plating technique.

The present disclosure provides a device for assisting in liquid phase deposition and an apparatus for liquid phase deposition, in which the apparatus includes the device to facilitate plating efficiency. The apparatus of the present disclosure can be applied in both the electroless plating technique and the electroplating technique. In addition, an approach of the present disclosure can effectively improve distribution of ions in a plating chamber, and thus a thin film with improved uniformity can be formed on a workpiece.

Figure 2:
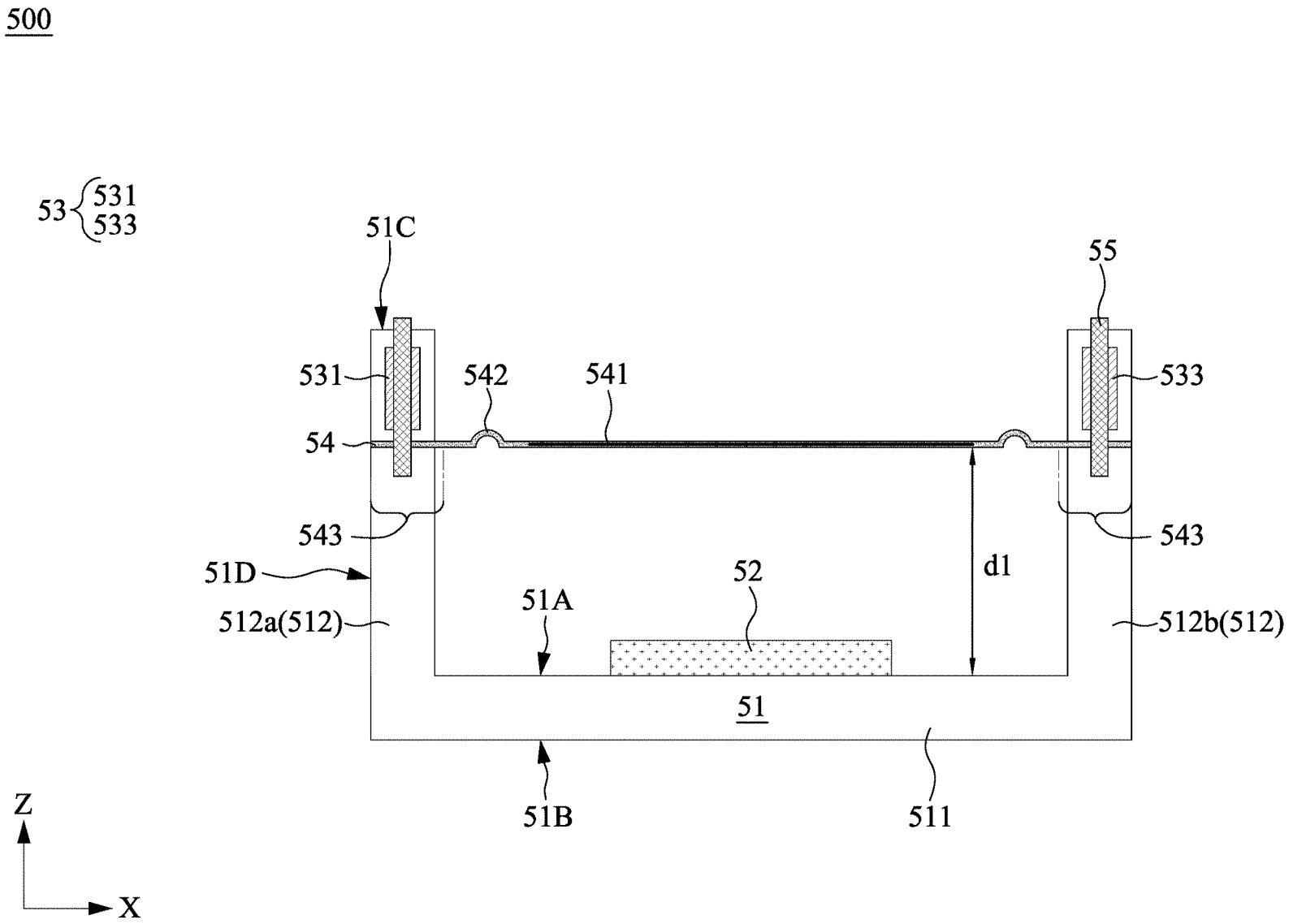
FIG. 2 is a schematic cross-sectional diagram of the device along a line A-A' in FIG. 1 in accordance with some embodiments of the present disclosure.

Referring to FIGS. 1 and 2, FIG. 1 is a schematic top-view diagram of a device 500 for assisting in liquid phase deposition, and FIG. 2 is a schematic cross-sectional diagram of the device 500 along a line A-A' in FIG. 1 in accordance with some embodiments of the present disclosure. The device 500 may include a frame 51, a first magnetic field generator 52, a second magnetic field generator 53, a flexible film 54, and a conductive coil 541 within the flexible film 54. In some embodiments, the frame 51 includes a bottom 511 and a sidewall 512 forming an angle with and connected to the bottom 511. In some embodiments, the sidewall 512 surrounds the bottom 511. In some embodiments, the frame 51 has a square or rectangular configuration from the top view as shown in FIG. 1. In some embodiments, the frame 51 has an open-box configuration including an opening facing in an upward direction (e.g., a Z direction), as shown in FIG. 2. In some embodiments, the frame 51 includes polyimide (PI), polytetrafluoroethylene (PTFE or Teflon), vinyl, polypropylene (PP), polyvinyl chloride (PVC), polyvinylidene difluoride (PVDF), stainless steel, other suitable materials, or a combination thereof. In some embodiments, the frame 51 is made of a magnetically conductive material.

The first magnetic field generator 52 may be disposed at the bottom 511 of the frame 51. In some embodiments, the first magnetic field generator 52 is disposed inside the frame 51 and attached to an interior bottom surface 51A of the frame 51. In some embodiments, the first magnetic field generator 52 is disposed at a central portion of the bottom 511 of the frame 51. A configuration of the first magnetic field generator 52 from the top view can be adjusted according to different applications. In some embodiments, the first magnetic field generator 52 has a rectangular configuration from the top view as shown in FIG. 1. The first magnetic field generator 52 is configured to provide a first magnetic field at least partially orthogonal to the bottom 511 of the frame 51. The first magnetic field generator 52 may include one or more magnets. In some embodiments, the one or more magnets can be permanent magnets. In some embodiments, the permanent magnet includes neodymium (Nd), iron (Fe), boron (B), an alloy thereof, or a combination thereof. In some embodiments, the first magnetic field generator 52 includes a square magnet as shown in FIG. 1. In other words, a north pole and a south pole of the magnet of the first magnetic field generator 52 are arranged in a direction (e.g., the Z direction) substantially perpendicular to the bottom 511. In some embodiments, the south pole of the magnet of the first magnetic field generator 52 is attached to the interior bottom surface 51A, the north pole of the magnet of the first magnetic field generator 52 is above the south pole, and the first magnetic field is directed in an upward direction orthogonal to the interior bottom surface 51A. For ease of description, when the magnetic field generator 52 or 53 includes only one magnet, the magnetic field generator 52 or 53 can be referred to as the magnet 52 or 53.

The second magnetic field generator 53 may be disposed at the sidewall 512 of the frame 51 and adjacent to the flexible film 54. In some embodiments, the second magnetic field generator 53 is disposed in the sidewall 512 proximal to an end of the sidewall 512 opposite to the bottom 511. It should be noted that the second magnetic field generator 53 can be entirely or partially within the sidewall 512 depending on different applications; thus, the figures are provided for a purpose of illustration only and are not intended to limit the present disclosure. The second magnetic field generator 53 may include one or more magnets. In some embodiments, the second magnetic field generator 53 includes magnets 531, 532, 533 and 534 disposed in the sidewall 512 surrounding the bottom 511. The magnets of the second magnetic field generator 53 may surround the bottom 511 of the frame 51 as evenly as possible. In some embodiments, each of the magnets 531, 532, 533 and 534 has an elongated configuration extending along a portion of the sidewall 512 from the top view as shown in FIG. 1. In some embodiments, the magnets 531 and 533 are disposed at two opposite portions 512*a* and 512*b* of the sidewall 512 as shown in FIGS. 1 and 2. In some embodiments, the magnets 532 and 534 are disposed between the magnets 531 and 533 and at two opposite portions of the sidewall 512 as shown in FIG. 1.

The second magnetic field generator 53 is configured to provide a second magnetic field at least partially parallel to the bottom 511 of the frame 51. In some embodiments, a north pole and a south pole of each of the magnets 531, 532, 533 and 534 of the second magnetic field generator 53 are arranged in a direction (e.g., an X direction) substantially parallel to the bottom 511. In some embodiments, the south pole of each of the magnets 531, 532, 533 and 534 faces toward an inside of the frame 51 and the north pole of each of the magnets 531, 532, 533 and 534 faces toward an outside of the frame 51.

The flexible film 54 may attach to the frame 51 at a periphery portion 543 of the flexible film 54. In some embodiments, the periphery portion 543 of the flexible film 54 is mounted, held, or fixed within the sidewall 511 of the frame 51. The flexible film 54 may be substantially parallel to the bottom 511 of the frame 51. In some embodiments, the flexible film 54 extends across an entire coverage area of the bottom 511 of the frame 51. In some embodiments, the flexible film 54 includes polyimide (PI), polyethylene terephthalate (or ethylene terephthalate) (PET), Ajinomoto Build-up Film (ABF), other suitable material, or a combination thereof. The flexible film 54 is configured to provide a vibrational movement to a plating solution during a deposition. The flexible film 54 and the frame 51 together define a resonant cavity, and a distance d1 between the flexible film 54 and the interior bottom surface 51A defines a height of the resonant cavity. A plating (or depositing) efficiency can be optimized by adjusting the distance d1 according to a material filling the resonant cavity. Detailed description is provided in the following paragraphs.

In some embodiments, the flexible film 54 includes an overhang portion 542 functioning as a spring for a purpose of facilitating a vibration amplitude of the flexible film 54 especially at a low frequency of vibration of the flexible film 54. In some embodiments, the overhang portion 542 has a configuration of an open-ring shape from the top view, as shown in FIG. 1. It should be noted that the ring shape of the overhang portion 542 can be a circle, a square, a triangle, a hexagon, or another suitable shape according to different applications. The circular ring shape of the overhang portion 542 shown in FIG. 1 is according to an exemplary embodiment, and the present disclosure is not limited thereto.

The conductive coil 541 is connected to the flexible film 54 and forms a spiral with respect to a coil axis substantially orthogonal to the bottom 511 of the frame 51. In some embodiments, the conductive coil 541 is disposed within the flexible film 54. In some embodiments, the conductive coil 541 is sealed or encapsulated by the flexible film 54. In some embodiments, the conductive coil 541 is at a central region of the flexible film 54 and surrounded by the overhang portion 542. In some embodiments, the conductive coil 541 includes aluminum (Al), copper (Cu), or other suitable materials. A configuration of the conductive coil 541 from the top view of FIG. 1 may vary according to different applications. For a purpose of ease of understanding and illustration, the conductive coil 541 can be considered as an element of the flexible film 54.

Figure 3A:
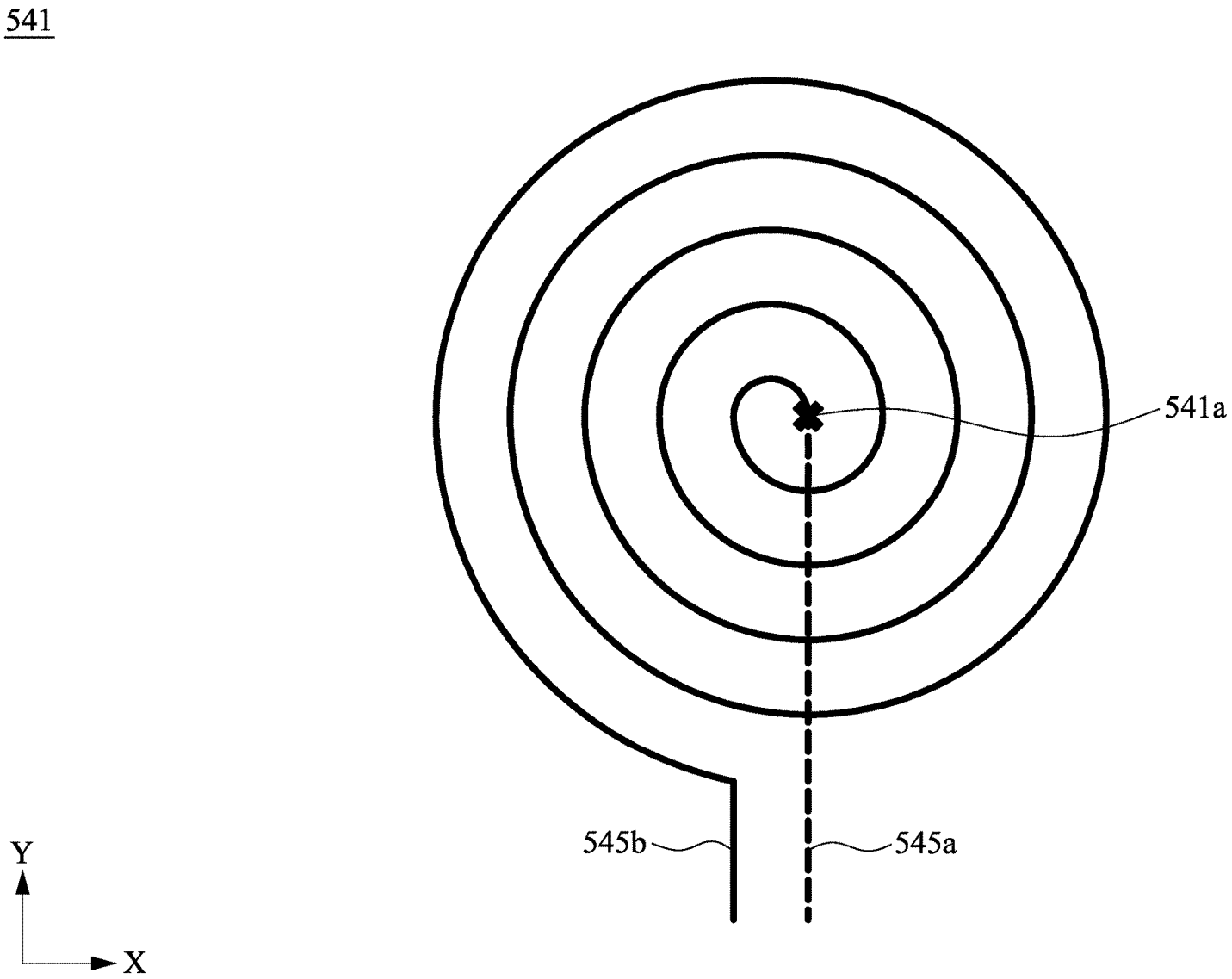
FIGS. 3A and 3B are schematic views showing configurations of a conductive coil of a device for assisting in liquid phase deposition in accordance with some embodiments of the present disclosure.
Figure 3B:
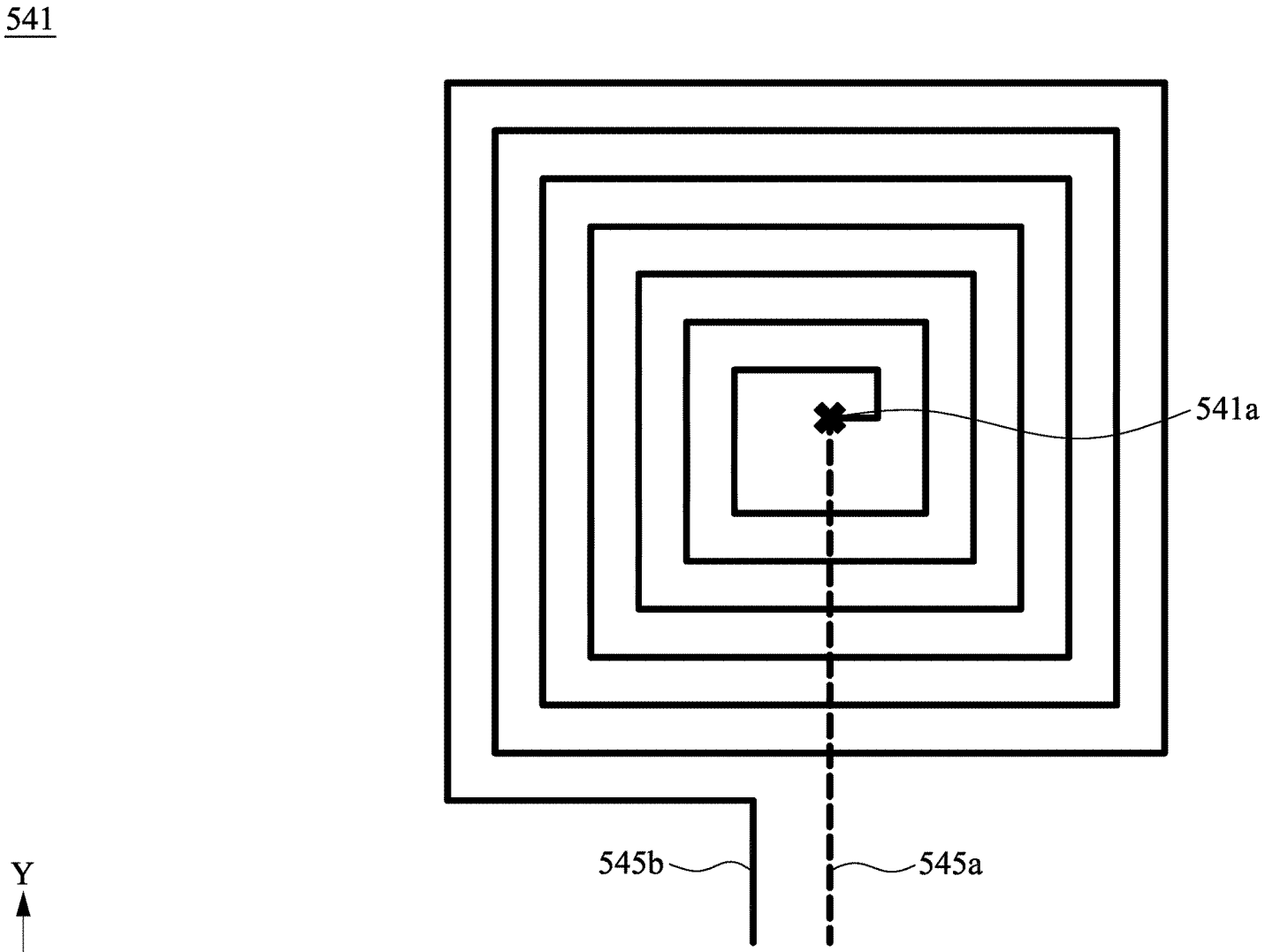

Referring to FIGS. 3A and 3B, FIGS. 3A and 3B are schematic top views of the conductive coil 541 of the device 500 for assisting in liquid phase deposition in accordance with different embodiments of the present disclosure. In some embodiments, as shown in FIG. 3A, the conductive coil 541 has a circular configuration from the top view. In some embodiments, as shown in FIG. 3B, the conductive coil 541 has a rectangular configuration from the top view. In some embodiments, the conductive coil 541 extends in a spiral from with respect to its coil axis 541*a* on the X-Y plane of the flexible film 54. It should be noted that the configurations shown in FIGS. 3A and 3B are for a purpose of illustration and are not intended to limit the present disclosure. As illustrated above, configurations of the conductive coil 541 can be designed according to different applications.

The conductive coil 541 is connected to conductive lines 545*a* and 545*b* at two ends of the conductive coil 541. The conductive lines 545*a* and 545*b* can be made of a conductive material selected from the conductive materials of the conductive coil 541 as listed above. In some embodiments, the conductive lines 545*a* and 545*b* are sealed or encapsulated by the flexible film 54. In some embodiments, the conductive lines 545*a* and 545*b* extend from the conductive coil 541 in the ring shape of the overhang portion 542 to a portion of the flexible film 54 outside of the ring shape of the overhang portion 542 through the opening of the overhang portion 542. The conductive lines 545*a* and 545*b* are for a purpose of carrying an electrical current to and from the conductive coil 541.

Referring back to FIGS. 1 and 2, the device 500 may further include a plurality of securing elements 55 configured to fix the second magnetic field generator 53 to the frame 51. The securing elements 55 may include stakes, nails, screws, rivets, other suitable fasteners, or a combination thereof. In some embodiments, the securing elements 55 are made of a magnetically conductive material. The securing elements 55 may be inserted into the sidewall 512 from a top surface 51C of the frame 51 and extend into at least a portion of each of the magnets 531, 532, 533 and 534 of the second magnetic field generator 53. In some embodiments, at least one of the securing elements 55 penetrates at least one of the magnets 531, 532, 533 and 534 as shown in FIG. 2. In some embodiments, at least one of the securing elements 55 penetrates the flexible film 54 at the peripheral portion 543 of the flexible film 54.

Figure 4:
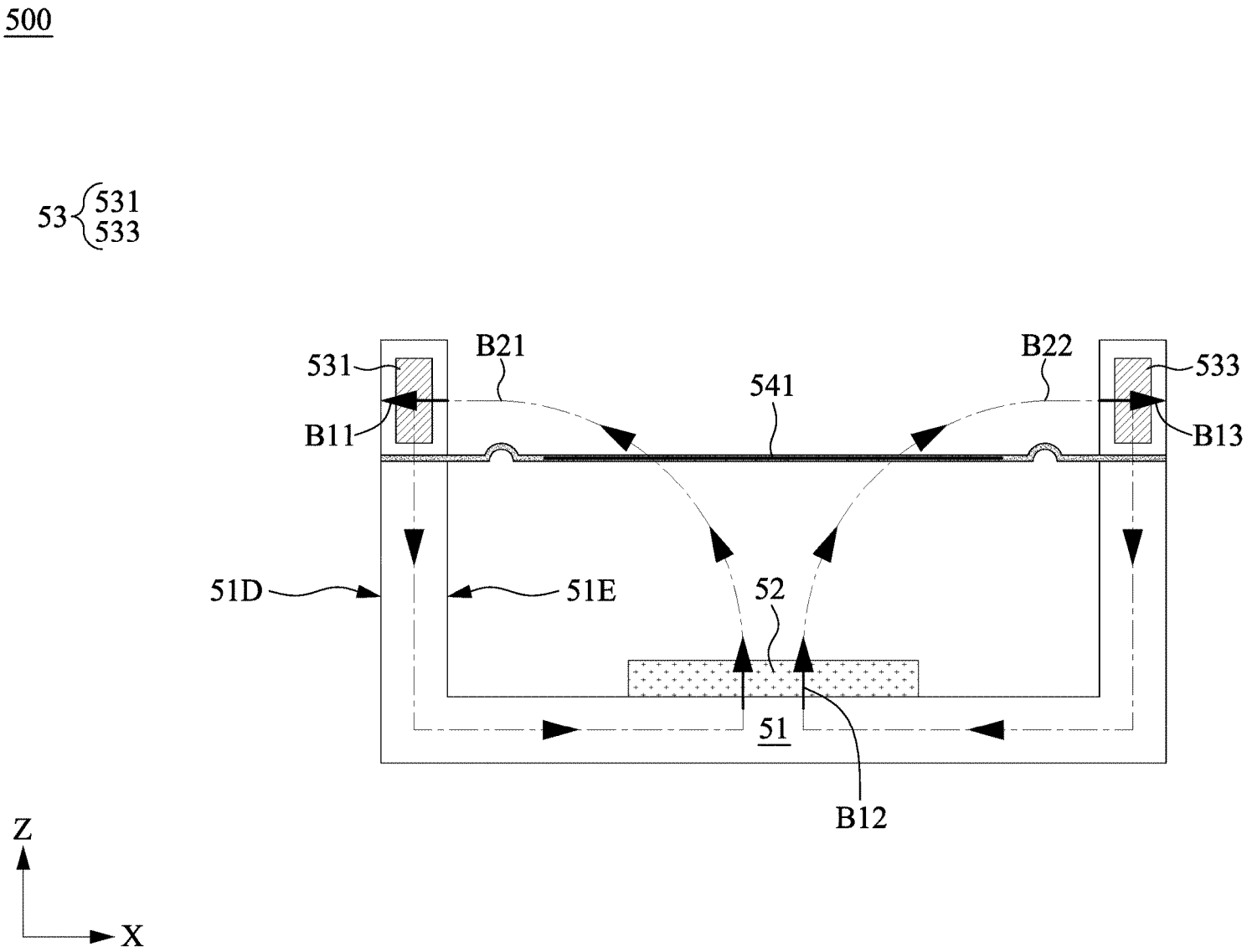
FIG. 4 is a schematic diagram illustrating magnetic lines of force established by a first magnetic field generator and a second magnetic field generator of a device for assisting in liquid phase deposition in accordance with some embodiments of the present disclosure.

Referring to FIG. 4, FIG. 4 is a schematic diagram illustrating magnetic lines of force established by the first magnetic field generator 52 and the second magnetic field generator 53 of the device 500. The first magnetic field generator 52 (may be referred to as a "magnet" hereinafter) and the second magnetic field generator 531 (may be referred to as a "magnet" hereinafter) commonly build up a magnetic field B21 (e.g., depicted and represented by the magnetic lines of force), at one end, perpendicular to the bottom of the frame 51 at the vicinity of the magnet 52, and at the other end, substantially parallel to the plane of the flexible film 54 at the vicinity of the magnet 531. The magnetic field B21 then enters the magnet 531 from an interior sidewall surface 51E toward an exterior sidewall surface 51D of the frame 51 along a horizontal direction (the −X direction), as labeled by the magnetic field B11, and then circulates back to the magnet 52 through the magnetic conductive route inside the frame 51 (for example, the frame 51 can be made of magnetically conductive materials). The magnetic field inside the magnet 52 is labeled B12, which meets the origin of the magnetic field B21 previously described and forms a closed loop. The magnetic fields B12, B21 and B11 depicted in FIG. 4 can be the design of the magnetic field established in the cross section along the line A-A' of FIG. 1.

Similarly, the first magnetic field generator 52 (may be referred to as a "magnet" hereinafter) and the second magnetic field generator 533 (may be referred to as a "magnet" hereinafter) commonly build up a magnetic field B22 (e.g., depicted and represented by the magnetic lines of force), at one end, perpendicular to the bottom of the frame 51 at the vicinity of the magnet 52, and at the other end, substantially parallel to the plane of the flexible film 54 at the vicinity of the magnet 533. The magnetic field B22 then enters the magnet 533 from an interior sidewall surface 51E toward an exterior sidewall surface 51D of the frame 51 along a horizontal direction (the +X direction), as labeled by the magnetic field B13, and then circulates back to the magnet 52 through the magnetic conductive route inside the frame 51. The magnetic field inside the magnet 52 is labeled B12, which meets the origin of the magnetic field B22 previously described and forms a closed loop. The magnetic fields B12, B22 and B13 depicted in FIG. 4 can be the design of the magnetic field established in the cross section along the line A-A' of FIG. 1.

Figure 5:
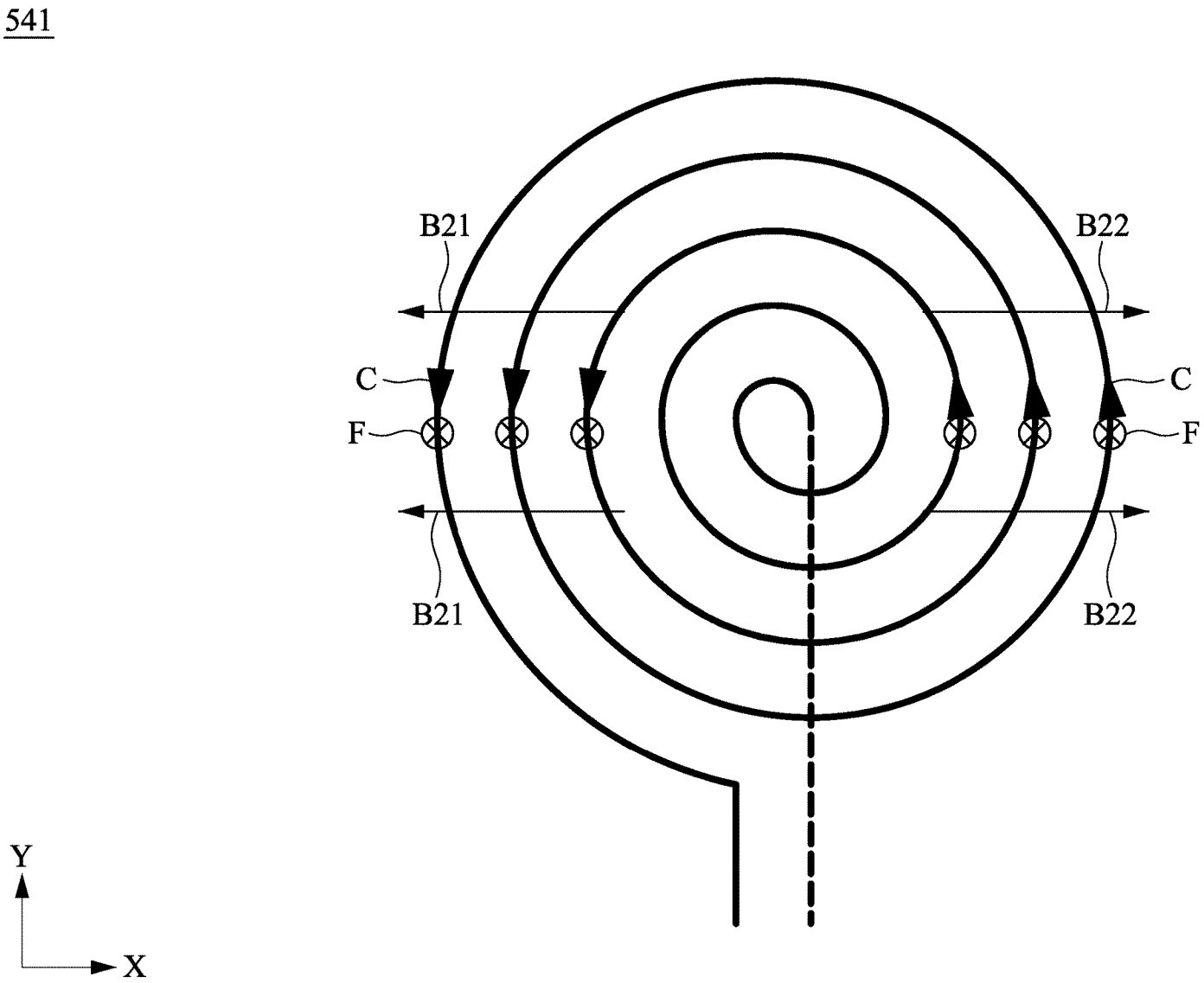
FIG. 5 is a schematic diagram of a conductive coil illustrating forces resulting from an interaction of a current flowing through a conductive coil with magnetic fields of a device for assisting in liquid phase deposition in accordance with some embodiments of the present disclosure.

Referring to FIG. 5, FIG. 5 is a schematic diagram of the conductive coil 541 illustrating a force being exerted on the conductive coil 541 resulting from an interaction of a current flowing through the conductive coil 541 with the magnetic fields B21 and B22 previously discussed in FIG. 4. At time T1, the current C may flow in the conductive coil 541 following a counterclockwise direction as indicated by arrows in FIG. 5. At time T2, the current C may flow in the conductive coil 541 following a clockwise direction (not shown in FIG. 5). For instance, the magnetic field B21 is substantially parallel to the plane of the conductive coil 514 and pointing to the −X direction. According to the Lorentz force equation (I), wherein q is an electrical charge of a cation, V is a velocity of the electron, E is an electric field, B is a magnetic field, and F is the electromagnetic force exerted on the cation. As exemplified in FIG. 5, when the magnetic fields B21 and B22 at the left portion and right portion, respectively, of the conductive coil 514 are established, the force F exerted on the cation; and hence the body of the conductive coil 514 and the flexible film 54 connected therewith, the force F is pointing inward or toward the paper (i.e., away from the viewer of FIG. 5), in the absence of electric filed E.

$$F=q(E+V\times B) \quad \text{(I)}$$

As a result, the flexible film 54 experiences a force F in the direction inward or toward the paper. In contrast, when the current C flow in the conductive coil 541 following a clockwise direction (not shown in FIG. 5) with other conditions unchanged, the resulting force F exerted on the flexible film 54 is in the direction outward from the paper (i.e., toward the viewer of FIG. 5). In some embodiments, the current C can be an alternating current or a direct current. When the conductive coil 541 is connected to an alternating current power source or a direct current power source having a duty cycle between 1% and 90%, a vibrational movement of the flexible film 54 is generated. In some embodiments, the alternating current power source or the direct current power source has a duty cycle of 50%. The vibrational movement of the flexible film 54 applied to a plating solution provides physical agitation thereto and therefore can improve a liquid phase deposition efficiency. The vibration provided by the device 500 provides mechanical agitation of various intensity on the plating solution in the plating chamber, fostering the movements and collision of reacting agents, and thus the efficiency of liquid phase deposition can be improved. A uniformity of a plated film formed on a workpiece by the plating process so described can also be improved.

Referring back to FIG. 2, the distance d1 between the flexible film 54 and the interior bottom surface 51A defines the height of the resonant cavity of the device 500. A vibration efficiency of the flexible film 54 can be controlled by an adjustment of the distance d1 according to a material in the resonant cavity. The vibration efficiency can be optimized when the distance d1 equals an integral multiple of an acoustic wavelength as defined in formula (II) below, wherein n is an integer number, λ is the acoustic wavelength, v is the speed of sound, and f is the acoustic frequency.

$$d1=n\lambda=nv/f \quad \text{(II)}$$

In some embodiments, the resonant cavity is filled with air, and a vibration medium of the device 500 is air. Therefore, the speed of sound v should be around 330 meters/second (m/s), which is the speed of sound in air. When n=1 (for a purpose of minimizing a thickness of the device 500 and optimizing the vibration efficiency at the same time), acoustic frequencies f and corresponding distances d1 (i.e., height of the resonant cavity) obtained by the equation (II) according to different embodiments of the present disclosure are provided in Table 1 below.

TABLE 1

| f (KHz) | d1 (cm) |
|---|---|
| 1.65 | 20 |
| 3.3 | 10 |
| 6.6 | 5 |
| 13.2 | 2.5 |
| 26.4 | 1.25 |

The device 500 as illustrated above can provide vibration to enhance an efficiency of the liquid phase deposition. The thickness of the device 500 can be adjusted by adjusting the distance d1 described above. However, the device 500 shown in FIGS. 1 and 2 is an exemplary embodiment for a purpose of illustration of the concept of the present disclosure, and is not intended to limit the present invention.

In the present disclosure, multiple embodiments of the present invention having an inventive concept same as that described above are provided. For a purpose of clarity and simplicity, reference numerals of elements with same or similar functions are repeated in different embodiments. However, such usage is not intended to limit the present disclosure to specific embodiments or specific elements. For a purpose of brevity, only differences from other embodiments are emphasized in the following specification, and descriptions of similar or same elements, functions and properties are omitted. In addition, conditions or parameters illustrated in different embodiments can be combined or modified to have different combinations of embodiments as long as the parameters or conditions used are not in conflict.

Figure 6:
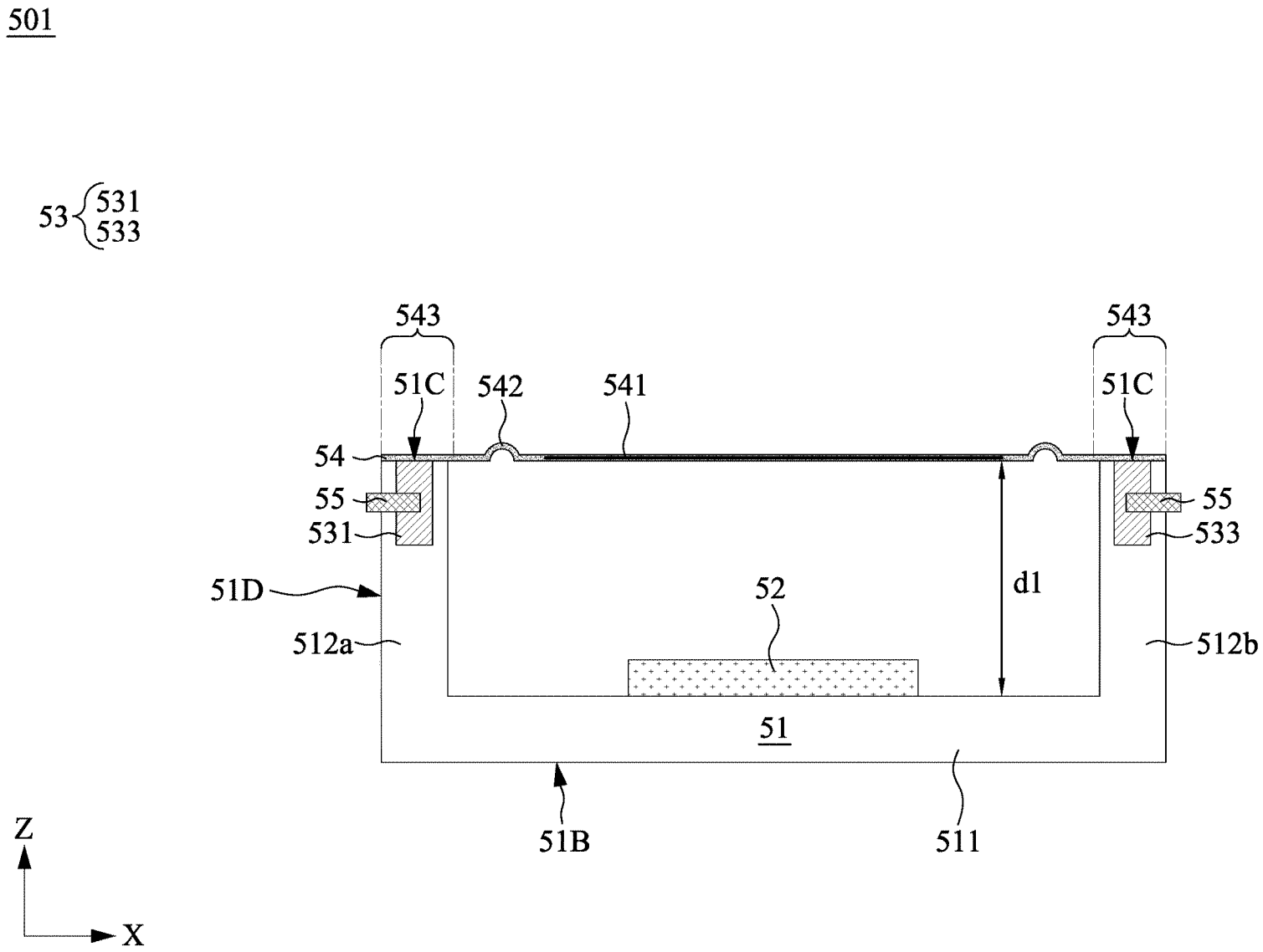
FIG. 6 is a schematic cross-sectional diagram of a device for assisting in liquid phase deposition in accordance with some embodiments of the present disclosure.

Referring to FIG. 6, FIG. 6 is a schematic cross-sectional diagram of a device 501 for assisting in liquid phase deposition in accordance with some embodiments of the present disclosure. In some embodiments, the flexible film 54 is attached to the top surface 51C of the sidewall 512 of the frame 51. In some embodiments, an entirety of the flexible film 54 is disposed over the frame 51. The flexible film 54 may be fixed on the frame 51 by glue, silicone, the securing elements 55, or other suitable materials. In some embodiments, the flexible film 54 is fixed by the securing elements 55, and an arrangement of the securing elements 55 is similar to that shown in FIG. 2. In some embodiments, the securing elements 55 are inserted into the sidewall 512 from the top surface 51C of the frame 51, thereby fixing the flexible film 54 over the top surface 51C (similar to that shown in FIG. 2 but not shown in FIG. 6). In some embodiments, the flexible film 54 is fixed on the frame 51 by glue or silicone, and the securing elements 55 are used to fix the second magnetic field generator 53 as shown in FIG. 6. In some embodiments, the securing elements 55 are inserted into the sidewall 512 from the exterior sidewall surface 51D of the frame 51 as shown in FIG. 6. In some embodiments, the securing elements 55 are inserted into the sidewall 512 from the interior sidewall surface 51E of the frame 51 (not shown). The securing element 55 may or may not penetrate the second magnetic field generator 53. In some embodiments, the securing elements 55 extend into and stop inside the second magnetic field generator 53 as shown in FIG. 6. Similarly, the securing element 55 may or may not penetrate the sidewall 512 of the frame 51. A top view of the device 501 can be similar to the top view of the device 500 shown in FIG. 1, and repeated illustration is omitted herein. A thickness of the device 501 may be less than that of the device 500 due to the arrangement of the flexible film 54 on the frame 51.

Figure 7:
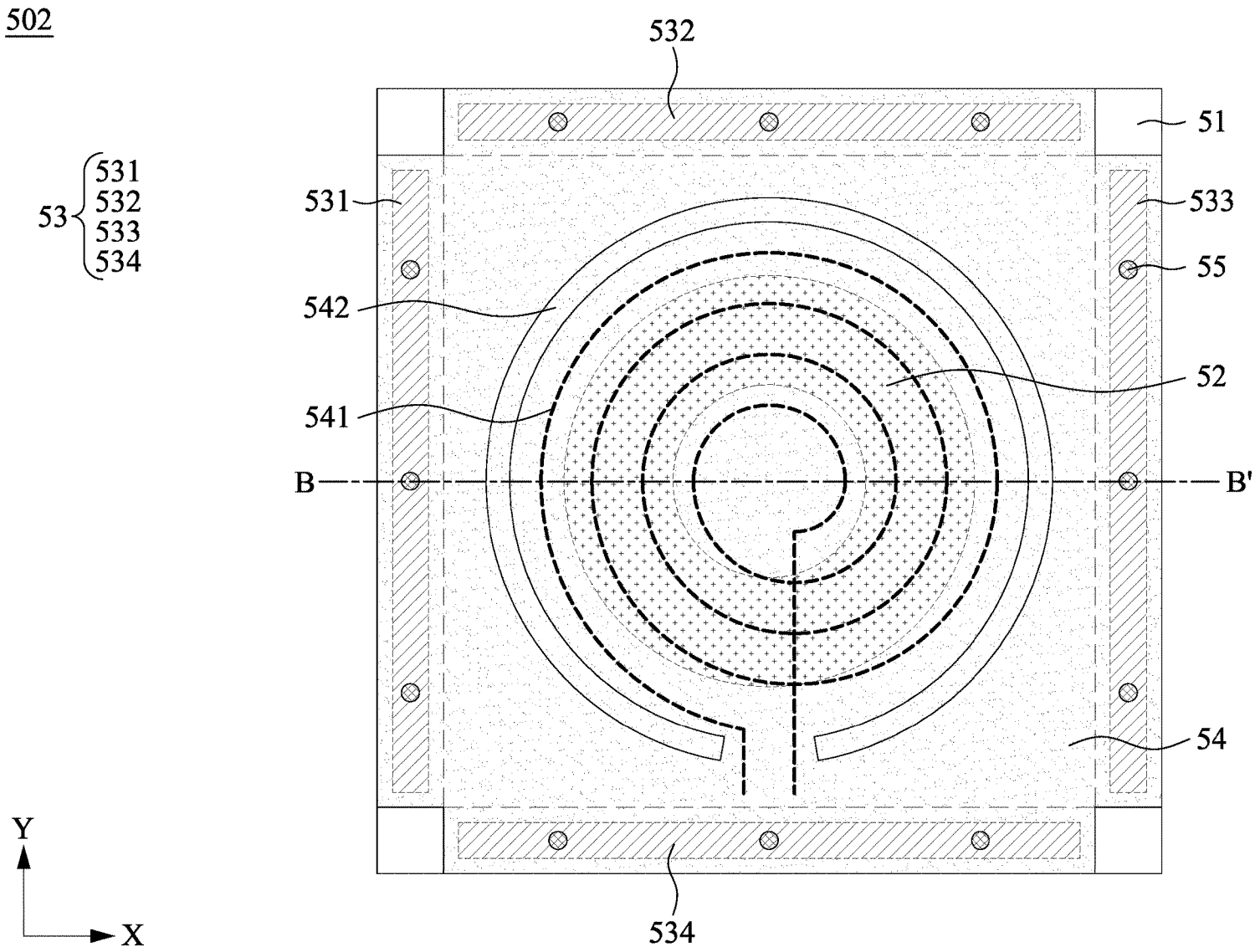
FIG. 7 is a schematic top-view diagram of a device for assisting in liquid phase deposition in accordance with some embodiments of the present disclosure.
Figure 8:
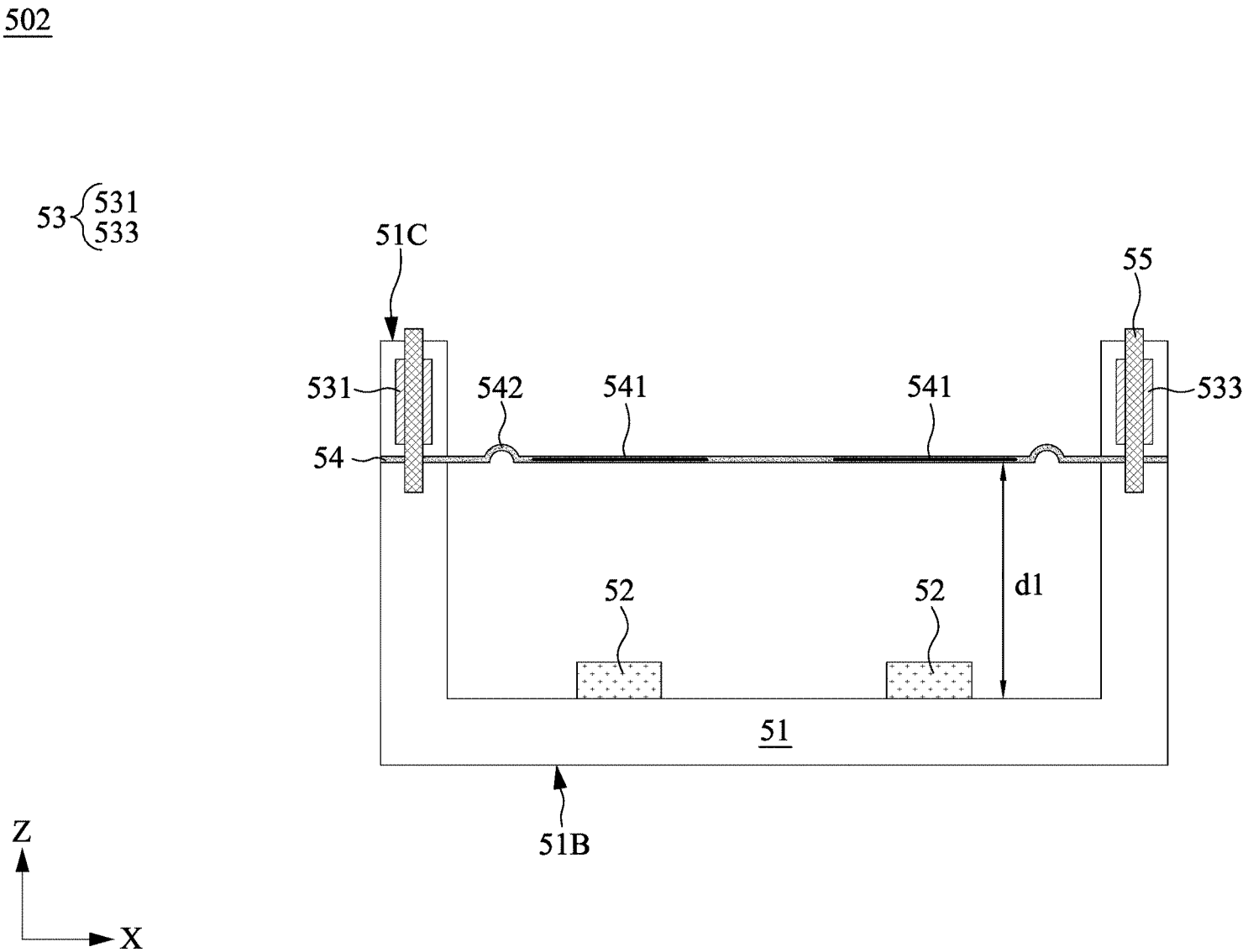
FIG. 8 is a schematic cross-sectional diagram of the device along a line B-B' in FIG. 7 in accordance with some embodiments of the present disclosure.
Figure 9B:
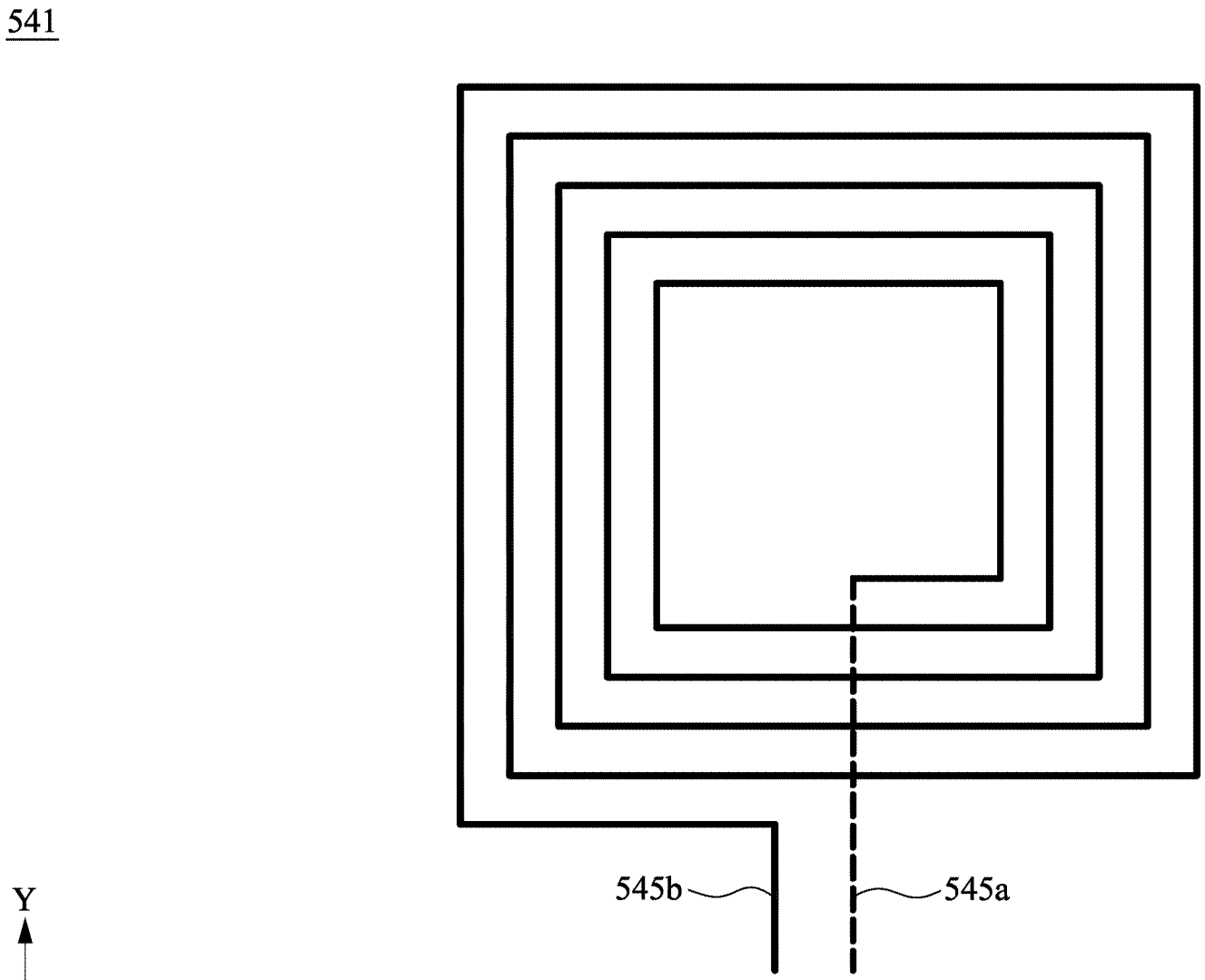

Referring to FIGS. 7 and 8, FIG. 7 is a schematic top-view diagram of a device 502 for assisting in liquid phase deposition, and FIG. 8 is a schematic cross-sectional diagram of the device 502 along a line B-B' in FIG. 7 in accordance with some embodiments of the present disclosure. The device 502 is similar to the device 500 but includes a magnet 52 in a ring shape and a conductive coil 541 in a ring shape with a loose coil density at center. The conductive coil 541 of the device 502 may be similar to the conductive coil 541 of the device 500, but the conductive coil 541 of the device 502 includes an innermost ring with a radius greater than a radius of an innermost ring of the conductive coil 541 of the device 500. FIGS. 9A and 9B are schematic top views of the conductive coil 541 of the device 502 in accordance with different embodiments of the present disclosure. FIGS. 9A and 9B are exemplary embodiments provided for a purpose of illustration, and are not intended to limit the present disclosure.

Figure 10:
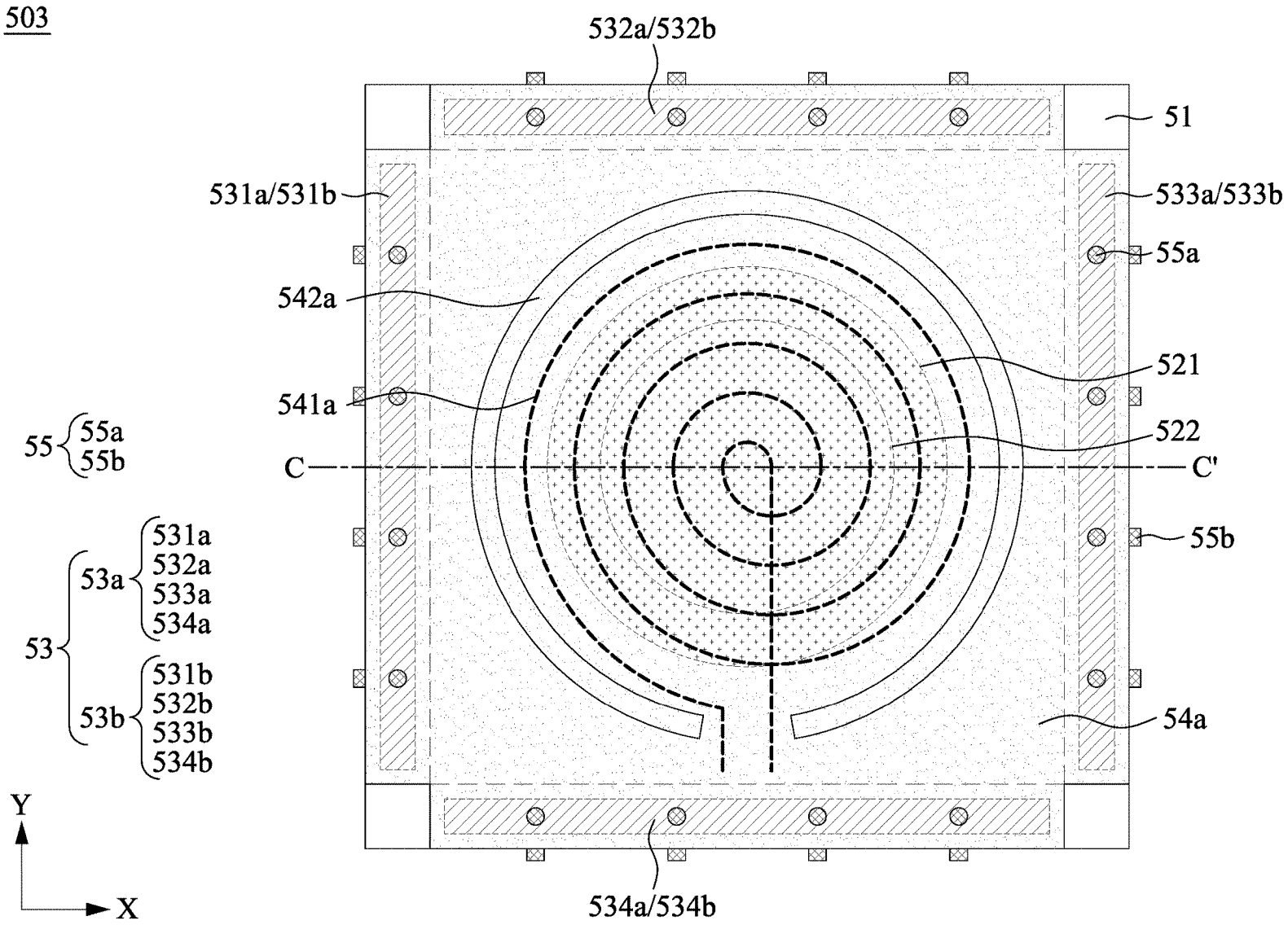
FIG. 10 is a schematic top-view diagram of a device for assisting in liquid phase deposition in accordance with some embodiments of the present disclosure.
Figure 11:
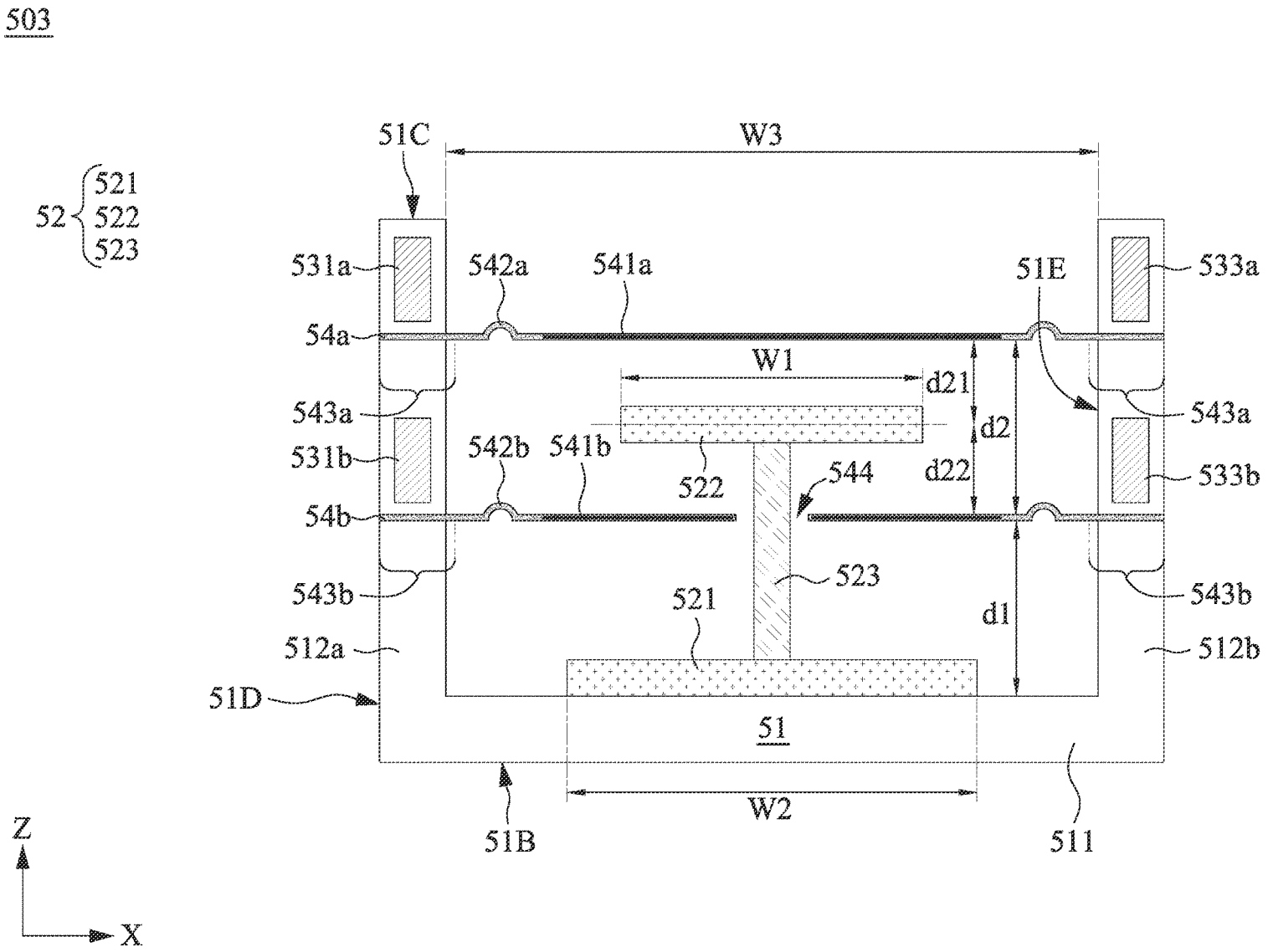
FIG. 11 is a schematic cross-sectional diagram of the device along a line C-C' in FIG. 10 in accordance with some embodiments of the present disclosure.

Referring to FIGS. 10 and 11, FIG. 10 is a schematic top-view diagram of a device 503 for assisting in liquid phase deposition, and FIG. 11 is a schematic cross-sectional diagram of the device 503 along a line C-C' in FIG. 10 in accordance with some embodiments of the present disclosure. In some embodiments, the device 503 includes a plurality of flexible films (e.g., 54*a* and 54*b*) vertically arranged and substantially parallel to one another. In some embodiments, the flexible film 54*a* is above the flexible film 54*b* and separated from the flexible film 54*b* by a distance d2. The distance d2 defines a height of a resonant cavity of the flexible film 54*a*, and is equal to a distance between the flexible film 54*a* and the flexible film 54*b*. In some embodiments, the distance d2 is substantially equal to the distance d1 in order to have a resonance frequency of the resonant cavity of the flexible film 54*a* same as a resonance frequency of the resonant cavity of the flexible film 54*b* for a purpose of maximize an efficiency of vibration of the device 503. In some embodiments, the flexible film 54*a* overlaps an entirety of the flexible film 54*b* in the top view shown in FIG. 10.

The flexible film 54*a* can be similar to or same as the flexible film 54 of the device 500, and the flexible film 54*b* is disposed between the flexible film 54*a* and the bottom 511 of the frame 51. The flexible film 54*b* can be similar to the flexible film 54 of the device 502 but further includes an opening 544 allowing a connecting structure 523 to pass. The conductive coil 541*b* in connection with the flexible film 54*b* may also avoid the area of the opening and allow the connecting structure 523 to pass (for instance, the conductive coil 541*b* can be similar to that shown in FIGS. 9A and 9B). The conductive coil 541*b* can be similar to or substantially the same as the conductive coil 541 of the device 502. In some embodiments, the conductive coil 541*b* spirals out from the point adjacent to the opening 544.

For a purpose of generating magnetic fields parallel to at least a portion of the flexible film 54*a* and a portion of the flexible film 54*b*, the first magnetic field generator 52 may include a plurality of magnets (e.g., 521 and 522), wherein the magnets are vertically arranged. In some embodiments, the magnet 521 of the first magnetic field generator 52 is disposed on the bottom 51 (or an interior bottom surface 51A) of the frame 51. An arrangement of the magnet 521 can be similar to that of the magnet 52 of the device 500 illustrated above, and repeated description is omitted herein. In some embodiments, a magnet 522 of the first magnetic field generator 52 is disposed between the flexible films 54*a* and 54*b*. In some embodiments, a ratio between a distance d21 and a distance d22 is in a range of 1:4 to 3:2, wherein the distance d21 is measured from the flexible film 54*a* to a central line (indicated in dotted lines) of the magnet 522 along a vertical direction, and the distance d22 is measured from the central line of the magnet 522 to the flexible film 54*b*. A width W1 of the magnet 521 as seen in the cross section of FIG. 11 can be less than, substantially equal to, or greater than a width W2 of the magnet 522. In some embodiments, the width of the magnet 522 is less than the width of the magnet 521, as shown in FIG. 11. For a purpose of minimizing a negative impact of the magnet 522 on a resonance efficiency of the device 503 on a solution, the width W1 of the magnet 521 is between ⅓ to ½ of a width W3 of a cavity of the frame 51 (e.g., a distance between different portions of the interior sidewall surfaces 51E shown in FIG. 11 along the line C-C' in FIG. 10). In some embodiments, the magnet 522 is smaller than the magnet 521 in the top view perspective as shown in FIG. 10. It should be noted that configurations of the magnets 521 and 522 from the top-view perspective are not limited to circular shapes as shown in FIG. 10. The circular shapes of the magnets 521 and 522 shown in FIG. 10 are exemplary embodiments for a purpose of illustration. In addition, the magnets 521 and 522 can be in different shapes from the top-view perspective depending on applications.

The magnets 522 can be supported by the connecting structure 523. In some embodiments, the connecting structure 523 is disposed between the magnets 521 and 522 and magnetically connecting the magnets 521 and 522. In some embodiments, the connecting structure 523 passes the opening 544 of the flexible film 54*b*. In some embodiments, the connecting structure 523 includes a magnetically conductive material. The connecting structure 523 can be considered as a part of the first magnetic field generator 52 when the connecting structure 523 includes a magnetically conductive material.

The second magnetic field generator 53 may include vertically arranged magnets. The second magnetic field generator 53 may include a first plurality of magnets 53*a* vertically overlapping a second plurality of magnets 53*b*. In some embodiments, the first plurality of magnets 53*a* includes magnets 531*a*, 532*a*, 533*a* and 534*a* in an arrangement similar to an arrangement of the magnets 531, 532, 533 and 534 of the second magnetic field generator 53 of the device 500 shown in FIGS. 1 and 2. In some embodiments, the second plurality of magnets 53*b* includes magnets 531*b*, 532*b*, 533*b* and 534*b* vertically aligned with each of the magnets 531*a*, 532*a*, 533*a* and 534*a*. In some embodiments, each of the magnets 531*a*, 532*a*, 533*a* and 534*a* of the first plurality of magnets 53*a* is fixed on the frame 51 by one or more securing members 55*a*. The securing member 55*a* can horizontally or vertically extend (or be inserted) into the sidewall 512 of the frame 51 from a top surface 51C, an interior sidewall surface 51E or an exterior sidewall surface 51D. In some embodiments, each of the magnets 531*b*, 532*b*, 533*b* and 534*b* of the second plurality of magnets 53*b* is fixed on the frame 51 by one or more securing members 55*b*. The securing member 55*b* may horizontally extend (or be inserted) into the sidewall 512 of the frame 51 from the interior sidewall surface 51E or the exterior sidewall surface 51D.

The first plurality of magnets 53*a* may be disposed above the flexible film 54*a* and proximal to a top surface 51C of the frame 51. In some embodiments, the magnets 531*a*, 532*a*, 533*a* and 534*a* are disposed adjacent to a peripheral region 543*a* of the flexible film 54*a*. The magnet 522 and the first plurality of magnets 53*a* may result in magnetic fields similar to the magnetic fields B21 and B22 as described above and illustrated in FIG. 4, and a vibrational movement of the flexible film 54*a* can be generated when a current is provided to a conductive coil 541*a* of the flexible film 54*a*.

The second plurality of magnets 53*b* may be disposed between the flexible films 54*a* and 54*b* and proximal to the flexible film 54*b*. In some embodiments, the magnets 531*b*, 532*b*, 533*b* and 534*b* are disposed adjacent to a peripheral region 543*b* of the flexible film 54*b*. The magnet 521 and the second plurality of magnets 53*b* may result in magnetic fields similar to the magnetic fields B21 and B22 as described above and illustrated in FIG. 4, and a vibrational movement of the flexible film 54*b* can be generated when a current is provided to a conductive coil 541*b* of the flexible film 54*b*.

Figure 12:
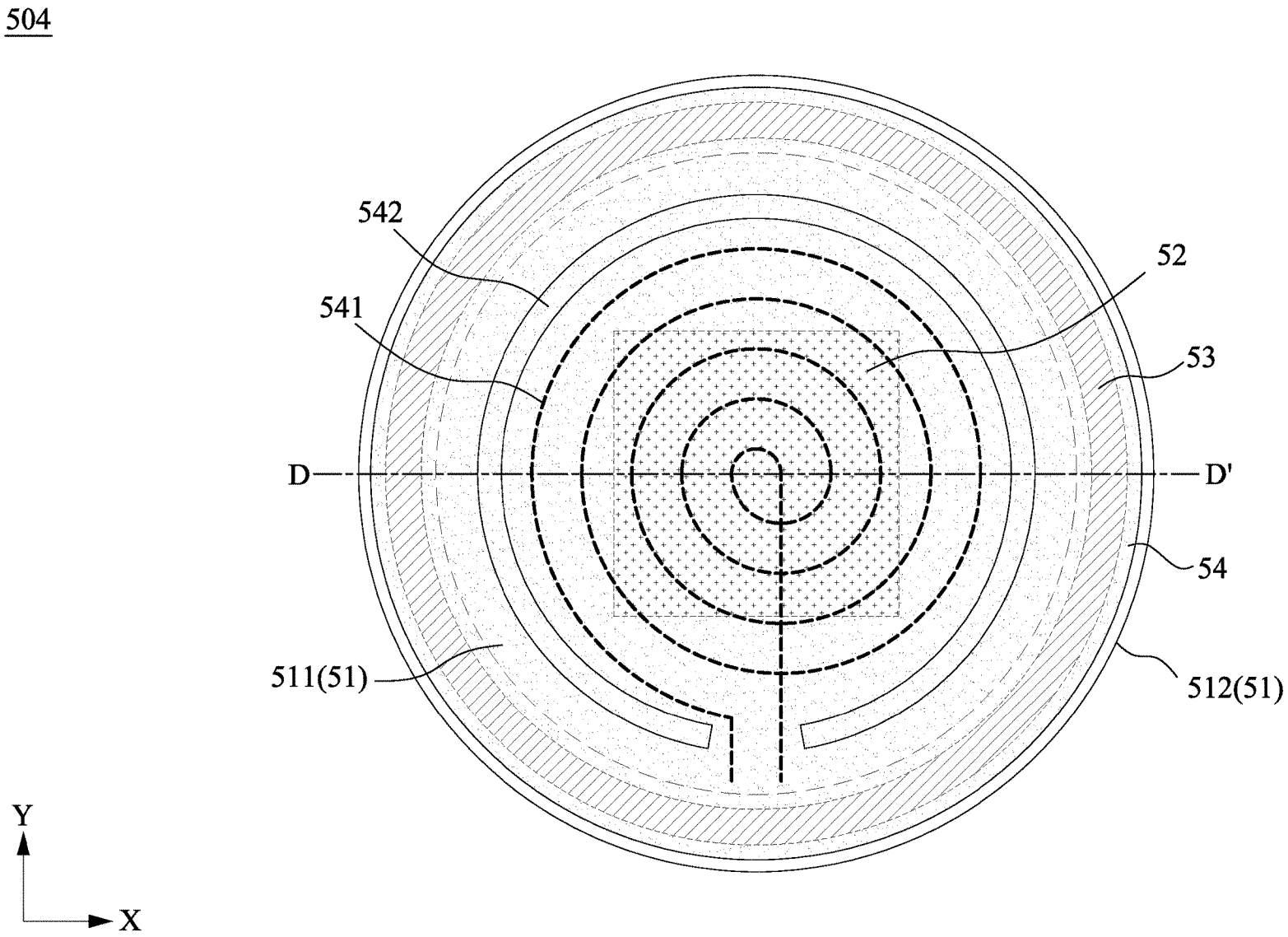
FIG. 12 is a schematic top-view diagram of a device for assisting in liquid phase deposition in accordance with some embodiments of the present disclosure.
Figure 13:
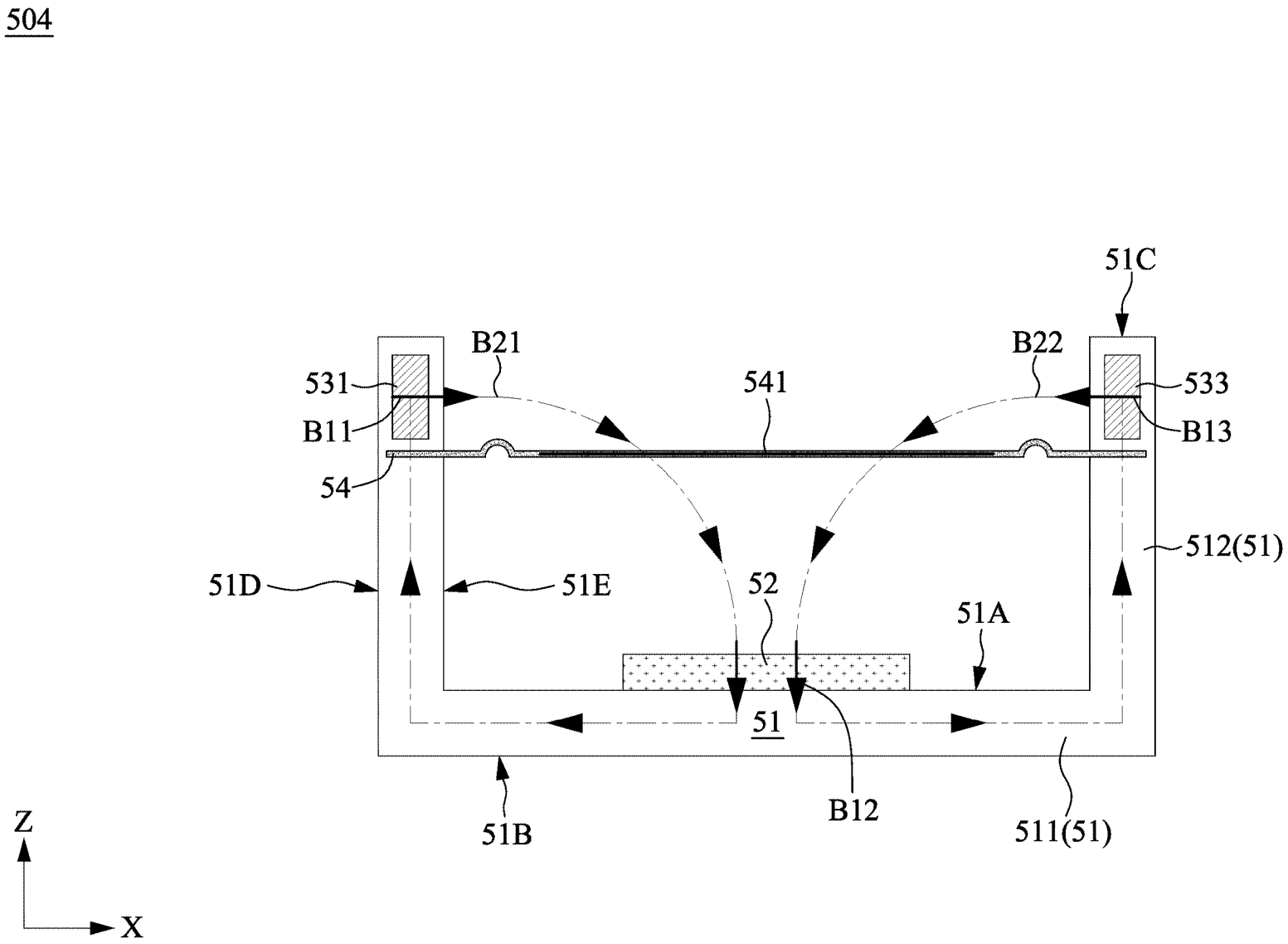
FIG. 13 is a schematic cross-sectional diagram of the device along a line D-D' in FIG. 12 illustrating magnetic lines of force of the device in accordance with some embodiments of the present disclosure.

Referring to FIGS. 12 and 13, FIG. 12 is a schematic top-view diagram of a device 504 for assisting in liquid phase deposition, and FIG. 13 is a schematic cross-sectional diagram of the device 504 along a line D-D' in FIG. 12 in accordance with some embodiments of the present disclosure. The device 504 may be similar to the device 500 but with a different configuration of the frame 51 and a different geometric configuration of the second magnetic field generator 53 from the top view shown in FIG. 12. In some embodiments, the frame 51 has a circular configuration in the top view. In some embodiments, the second magnetic field generator 53 includes a ring-shaped magnet (the second magnetic field generator 53 may be referred to as a magnet 53 herein). In some embodiments, the magnet 53 extends within and along a sidewall 512 of the frame 51, wherein the sidewall 51 has a ring-shaped configuration. In some embodiments, the magnet 53 is sealed by and fixed in the sidewall 512 without a securing member 55.

In addition, the device 504 may be similar to the device 500 but with a polarity configuration of the first and second magnetic field generator 52 and 53 different from the first and second magnetic field generator 52 and 53 of the device 500 as previously illustrated in FIG. 4. The first magnetic field generator 52 (may be referred to as a "magnet" hereinafter) and a portion 531 of the second magnetic field generator 53 (may be referred to as a "magnet" hereinafter) commonly build up a magnetic field B21 (e.g., depicted and represented by the magnetic lines of force), at one end, perpendicular to the bottom of the frame 51 at the vicinity of the magnet 52, and at the other end, substantially parallel to the plane of the flexible film 54 at the vicinity of the portion 531 of the magnet 53. The magnetic field B21 then enters the magnet 52, connecting with the magnetic field B12 build up in the magnet 52, and then circulates back to the portion 531 of the magnet 53 through the magnetic conductive route inside the frame 51 (for example, the frame 51 can be made of magnetically conductive materials). The magnetic field inside the portion 531 of the 53 is labeled B11, which meets the origin of the magnetic field B21 previously described and forms a closed loop. The magnetic fields B11, B21 and B12 depicted in FIG. 13 can be the design of the magnetic field established in the cross section along the line D-D' of FIG. 12.

Similarly, the first magnetic field generator 52 (may be referred to as a "magnet" hereinafter) and a portion 533 of the second magnetic field generator 53 (may be referred to as a "magnet" hereinafter) commonly build up a magnetic field B22 (e.g., depicted and represented by the magnetic lines of force), at one end, perpendicular to the bottom of the frame 51 at the vicinity of the magnet 52, and at the other end, substantially parallel to the plane of the flexible film 54 at the vicinity of the portion 533 of the magnet 53. The magnetic field B22 then enters the magnet 52, connecting with the magnetic field B12 build up in the magnet 52, and then circulates back to the portion 533 of the magnet 53 through the magnetic conductive route inside the frame 51 (for example, the frame 51 can be made of magnetically conductive materials). The magnetic field inside the portion 533 of the magnet 53 is labeled B13, which meets the origin of the magnetic field B22 previously described and forms a closed loop. The magnetic fields B13, B22 and B12 depicted in FIG. 13 can be the design of the magnetic field established in the cross section along the line D-D' of FIG. 12.

Referring to FIG. 14, FIG. 14 is a schematic diagram of the conductive coil 541 of the device 504 illustrating forces being exerted on the conductive coil 541 resulting from an interaction of a current flowing through the conductive coil 541 with the magnetic fields B21 and B22 previously discussed in FIG. 13. According to the Lorentz force equation (I) as described previously, the flexible film 54 experiences a force F in the direction outward from the paper (i.e., toward the viewer of FIG. 14). The vibrational movement of the flexible film 54 applied to a plating solution provides physical agitation thereto and therefore can improve a liquid phase deposition efficiency. The vibration provided by the device 504 provides mechanical agitation of various intensity on the plating solution in the plating chamber, fostering the movements and collision of reacting agents, and thus the efficiency of liquid phase deposition can be improved. A uniformity of a plated film formed on a workpiece by the plating process so described can also be improved.

Figure 15:
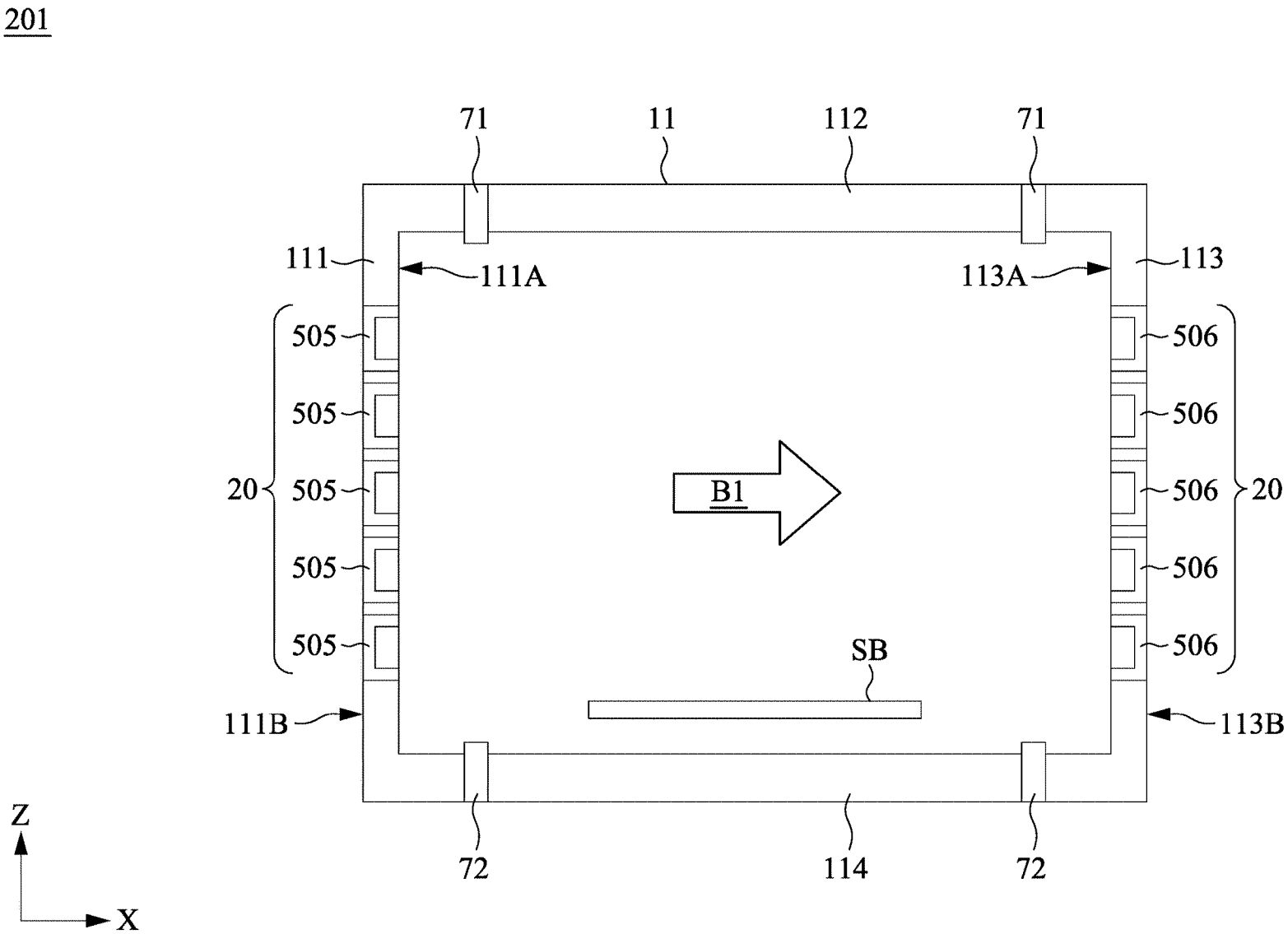
FIGS. 15 to 19 are schematic diagrams of different plating apparatuses in accordance with different embodiments of the present disclosure.

Referring to FIG. 15, FIG. 15 is a schematic side-view of a plating apparatus 201 in accordance with some embodiments of the present disclosure. The plating apparatus 201 includes apparatus for liquid phase deposition. The plating apparatus 201 includes a chamber 11 and one or more vibration modules 20. The chamber 11 is configured to accommodate plating solution and a workpiece SB, which can be a semiconductor substrate, a wafer, a printed circuit board, or the like, disposed in the chamber 11, so that a plated film can be formed on the workpiece SB. It should be noted that the workpiece SB depicted in the figures is for a purpose of illustration to show its relative position in the chamber 11. The workpiece SB is located in the chamber 11 during a plating process, and can be disposed on a pedestal, a rack, or any supporting member (e.g., a supporting structure 80 shown in FIG. 26, detailed description is provided in the relevant paragraphs) that fixes the workpiece SB and exposes and surfaces to-be-plated thereon. In addition, a number or an orientation of the workpiece SB shown in the figures are for a purpose of illustration only. In some embodiments, multiple workpieces SB can be disposed in the chamber 11. An orientation of the workpieces SB can be along a horizontal direction (e.g., along a lower sidewall 114 of the chamber 11 or the X direction in FIG. 15) or along a vertical direction (e.g., substantially orthogonal to the lower sidewall 114 or a Z direction in FIG. 15). In some embodiments, the workpiece SB shown in the figures can represent an area for placing one or more substrates, and the plated film can be formed on all exposed surfaces of the one or more substrates in the area. In some embodiments, the plated film can be a copper-phosphorus film (which may include Cu3P) or a copper film.

The one or more vibration modules 20 are disposed in proximity to at least one of sidewalls 111 and 113 of the chamber 11. In some embodiments, the vibration modules 20 are disposed partially within, or being partially enclosed by, the sidewall 111 of the chamber 11. In some embodiments, the vibration module 20 refers to one or more individual devices 505 or 506. Each of the devices 505 or 506 can be similar to one of the devices 500, 501, 502, 503 and 504 as illustrated and described above. In order to have the flexible film of the device 505 or 506 in contact with the plating solution in the chamber 11, the open side fixturing the flexible film should be proximal to the interior surface 111A or 113A of the sidewall 111 or 113, and thereby facing and in contact with the plating solution. In some embodiments, an exterior bottom surface (e.g., 51B in FIG. 2, 6, 8, 11 or 13) of a frame of the device 505 or 506 is proximal to or faces toward an exterior surface 111B or 113B of the sidewall 111 or 113. In some embodiments, a top surface (e.g., 51C in FIG. 2, 6, 8, 11 or 13) of the frame of the device 505 or 506 is proximal to the interior surface 111A or 113A. In some embodiments, electrical components or elements (e.g., wires providing electrical pathways to conductive coils of the devices 505 or 506, or processing units to control electrical connections to the conductive coils) connected to the devices 505 or 506 may be enclosed in sidewalls 111 or 113 of the chamber 11, or at least being accessible from the exterior surface 111B or 113B of the sidewall 111 or 113 for the purpose of maintenance convenience.

As depicted in FIG. 15, the first magnetic field generators of each device 505 or 506, such as the first magnetic field generator 52 of the devices 500, 501, 502, 503 and/or 504, in combination provide a magnetic field B1 across the chamber 11 along a horizontal direction (e.g., X direction). In some embodiments, all of the first magnetic field generators of the devices 505 or 506 are having a same polarity and oriented in a same direction (e.g., S to the left and N to the right), so that the magnetic field B1 has a direction from the sidewall 111 toward the sidewall 113 of the chamber 11, as depicted in FIG. 15. In some other embodiments, all of the first magnetic field generators of the devices 505 or 506 are having a same polarity and oriented in a same direction (e.g., N to the left and S to the right), so that the magnetic field has a direction from the sidewall 113 toward the sidewall 111 of the chamber 11 (not illustrated in FIG. 15). According to the Lorentz force equation (I) previously described, along with the agitation to the plating solution caused by the vibration modules 20, force F experienced by charged (positive or negative) ions/reacting agents in the plating solution can be generated due to the presence of the magnetic field B1, causing a spiral trajectories of the charged ions/reacting agents to reach the plating surface of the workpiece SB. These spiral trajectories increase the possibilities of the charged ions/reacting agents to collide with the kinks, or the sites combines with which lowers the total Gibbs free energy, and thereby facilitate the production efficiency and uniformity of the plated film.

It should be noted that a number of the devices of each of the vibration module 20 is not limited herein. The five devices 505 and the five devices 506 shown in FIG. 15 are for a purpose of illustration only.

The plating apparatus 201 may further include multiple conduits. In some embodiments, the plating apparatus 201 includes one or more conduits 71 extending through an upper wall 112 of the chamber 11 and providing liquid pathway to or from the chamber 11. In some embodiments, the conduits 71 are configured to deliver chemicals or a plating solution into the chamber 11. In some embodiments, the plating apparatus 201 includes one or more conduits 72 extending through the lower wall 114 of the chamber 11 and providing liquid pathway to or from the chamber 11. In some embodiments, the conduits 72 are configured to drain chemicals or the plating solution from the chamber 11.

The present disclosure provides a plating apparatus including vibration modules each including at least one of a device for assisting in liquid phase deposition. An interaction between a local magnetic field established by a magnetic field generator of the device and current flows within a conductive coil of said device results in vibration of the flexible film of the vibration module. An interaction between a macro magnetic field established by each individual magnetic field generator of the device and the charged ions/reacting agents in the plating solution results in spiral trajectories of said charged ions/reacting agents. The vibration facilitates agitation or stirring of a plating solution in a plating chamber during a plating process, and the macro magnetic field provides spiral trajectories to the charged ions/reacting agents so as to increase the plating efficiency and film uniformity.

Figure 16:
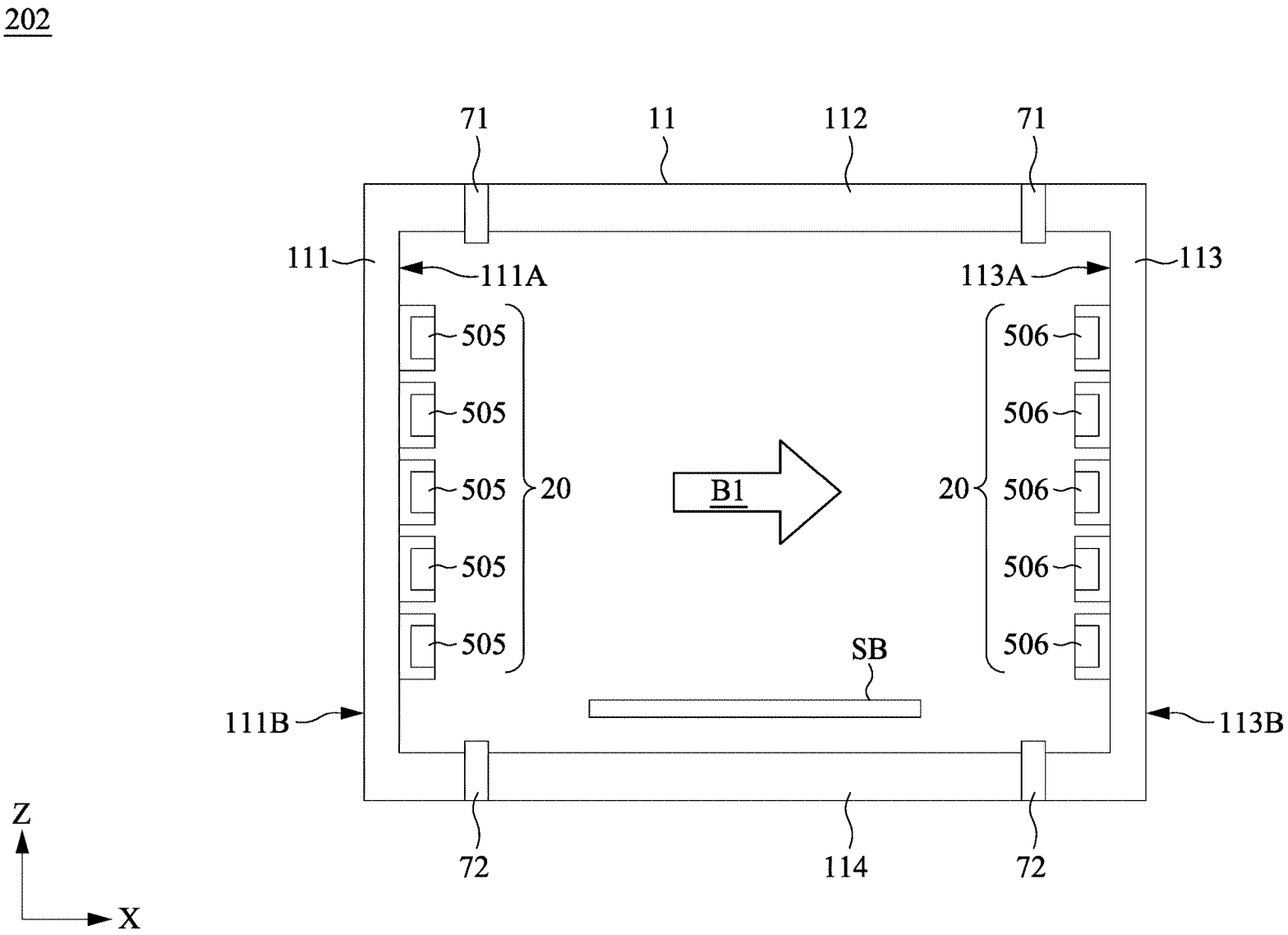

Referring to FIG. 16, FIG. 16 is a schematic side-view of a plating apparatus 202 in accordance with some embodiments of the present disclosure. The plating apparatus 202 can be similar to the plating apparatus 201, but includes a vibration module 20 disposed on an interior surface 111A of a sidewall 111 and an interior surface 113A of the sidewall 113 opposite to the sidewall 111 of a chamber 11. In some embodiments, each of devices 505 or 506 of the vibration module 20 is attached to or fixed on the interior surface 111A or 113A, e.g., by silicone or other suitable materials. The embodiments shown in FIG. 16 may provide advantages of easier integration of the devices of the present disclosure to a plating chamber.

Figure 17:
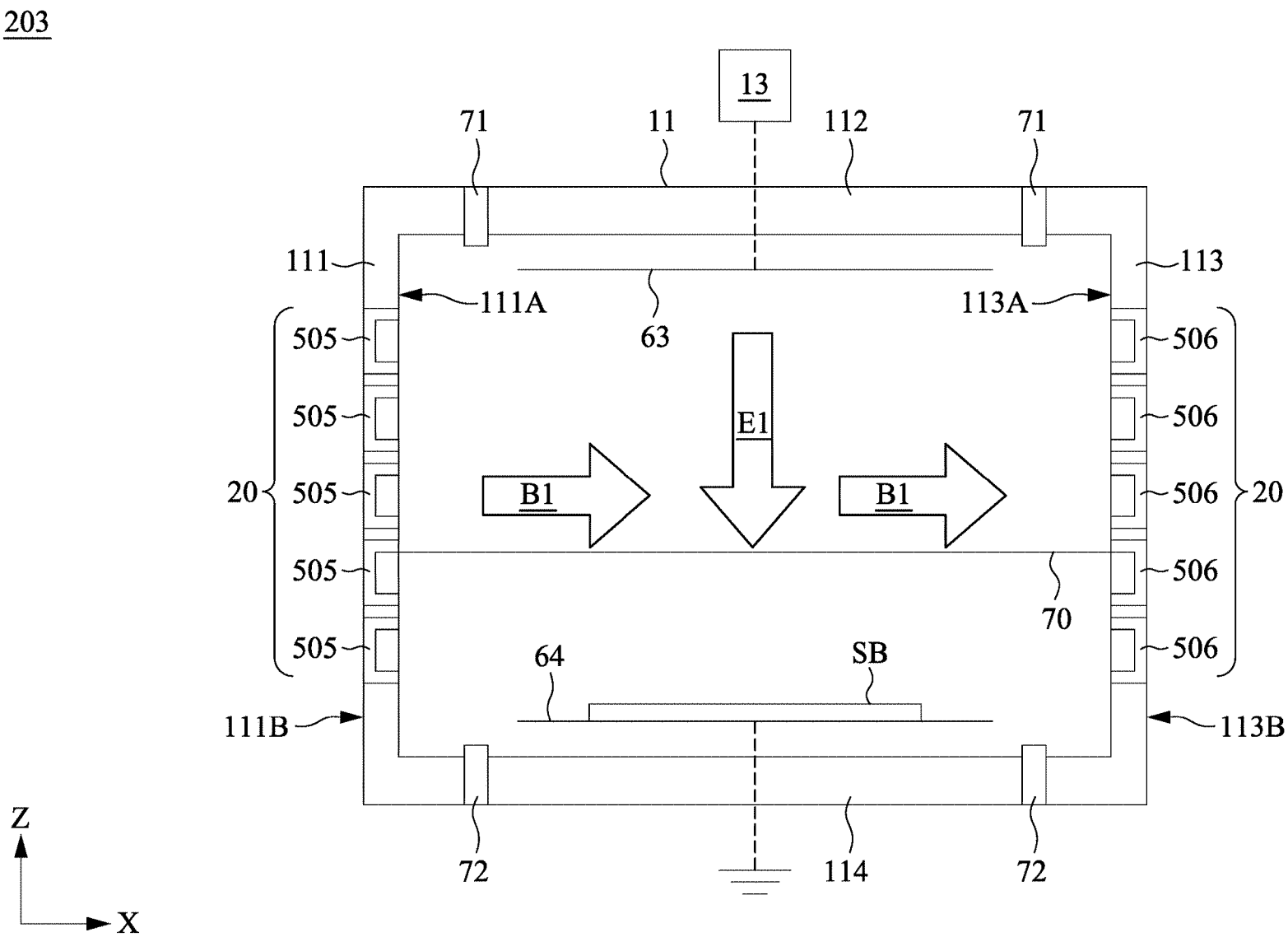

Referring to FIG. 17, FIG. 17 is a schematic side-view of a plating apparatus 203 in accordance with some embodiments of the present disclosure. The plating apparatus 203 can be used as an electroless plating apparatus or an electroplating apparatus, and may be similar to the plating apparatus 201 but further includes a pair of electrodes disposed across the vertical direction of the plating apparatus 203. For example, the pair of electrodes includes a positive electrode 63 and a negative electrode 64 disposed inside the chamber 11 and exposed to the plating solution during the plating operation. In some embodiments, the plating apparatus 203 further includes a separator 70 disposed over a workpiece SB and between the positive electrode 63 and the negative electrode 64. In some embodiments, the separator 70 is a proton exchange membrane or a polymer electrolyte membrane (PEM). In some embodiments, the separator 70 is a perfluorinated membrane (commercially available as NAFION® membranes). The separator 70 is permeable only to positive ions or reacting agents of deposition of the plated film, or alternatively, the separator 70 is permeable to water and cations in the plating solutions and thus a quality of the plated film can be improved.

The positive electrode 63 and the negative electrode 64 provide an electrical field E1 having a downward direction as shown in FIG. 17. In some embodiments, when the plating apparatus 203 is used as an electroplating apparatus, the positive electrode 63 is electrically connected to a power source 13 during an electroplating operation. In some embodiments, when the plating apparatus 203 is used as an electroless plating apparatus, and the positive electrode 63 is electrically disconnected from the power source 13 during the electroless plating operation.

In order to facilitate coating of a metal or a metal-containing alloy film on a workpiece SB, cations or positive reacting agents should be guided toward the workpiece SB or in a downward direction in FIG. 17. A downward force exerted on positive reacting agents in the plating solution is generated due to a presence of the downward electrical field E1. Along with the interaction of a magnetic field B1 and the electrical field E1, the positive reacting agents are guided to follow a downward spiral trajectories according to the Lorentz force equation (I) described above. The plating apparatus 203 of the present disclosure can facilitate movement of positive reacting agents in the plating solution toward the workpiece SB, thereby improving plating efficiency. These downward spiral trajectories increase the possibilities of the positive reacting agents to collide with the kinks, or the sites combines with which lowers the total Gibbs free energy, and thereby facilitate the production efficiency and uniformity of the plated film. In addition, in contrast to the downward movement of the positive reacting agents, the establishment of the magnetic and electric fields previously described also results in an upward spiral movement of negative reacting agents in the plating solution. The upward movement of the negative reacting agents can prevent reductions of the positive reacting agents should the positive and negative reacting agents are not separated and collide in a mid-way that facilitates the reduction reaction, and thus an efficiency of liquid phase deposition can be improved. In some embodiments, the separator 70 can be selected to block the negative reacting agents, including electrons or cations, from being moving upward so as to deposit on the positive electrode 63, in which case may affect the function of the positive electrode 63 during the liquid phase deposition. Therefore, the quality of the deposited film can be improved with the presence of the separator 70.

Figure 18:
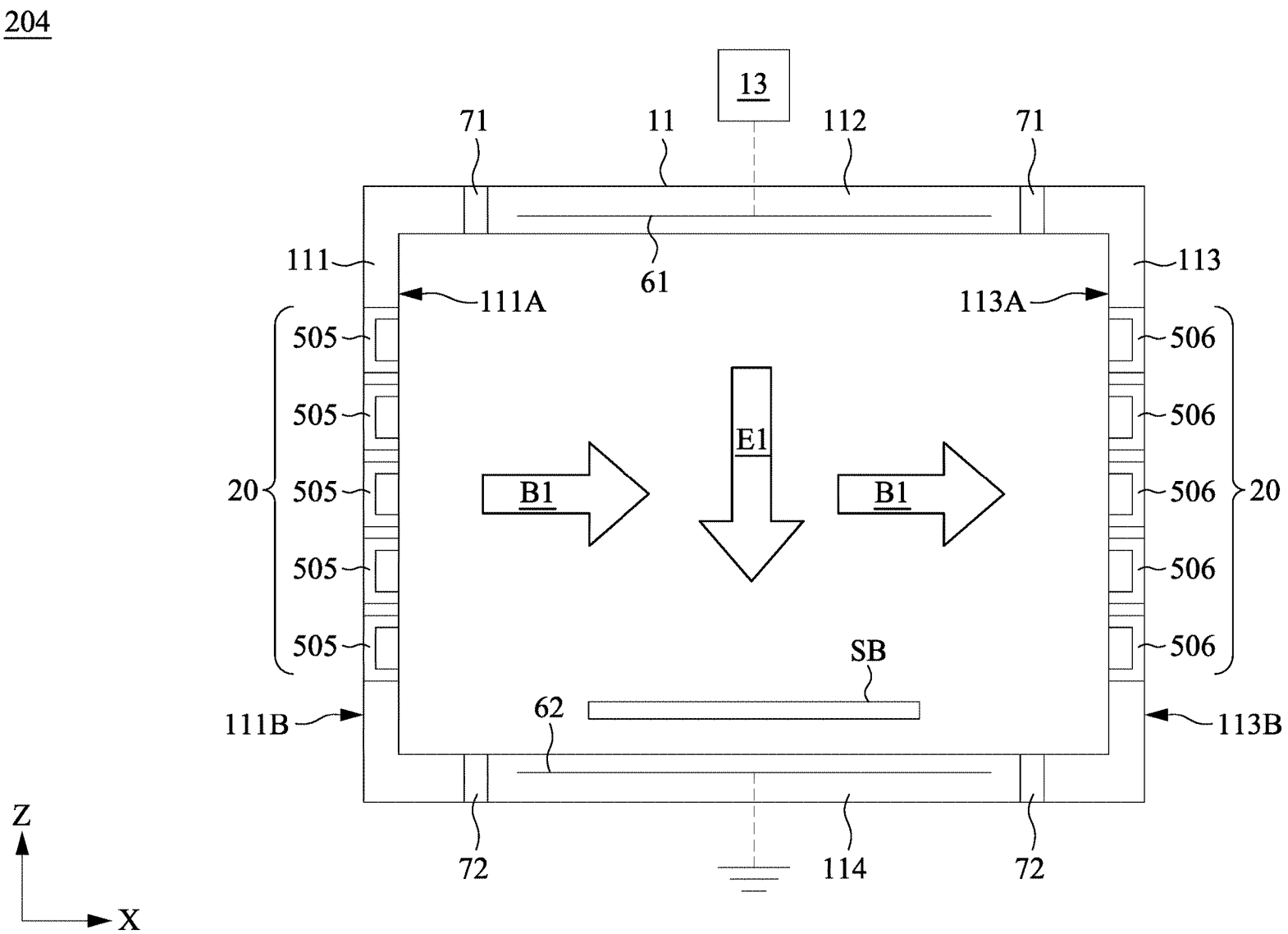

Referring to FIG. 18, FIG. 18 is a schematic side-view of a plating apparatus 204 in accordance with some embodiments of the present disclosure. The plating apparatus 204 can be used as an electroless plating apparatus, and may be similar to the plating apparatus 203 but includes a positive electrode 61 and a negative electrode 62 separated from a plating solution during a plating operation. In some embodiments, the positive electrode 61 and the negative electrode 62 are for the purpose of establishing an electric filed vertically across the plating apparatus 203 but is not in contact with the plating solution.

In some embodiments, the plating apparatus 204 includes the positive electrode 61 disposed inside an upper wall 112 and the negative electrode 62 disposed inside a lower wall 114 opposite to the upper wall 112. In some embodiments, the electrodes 61 and 62 are enclosed by polytetrafluoroethylene (PTFE or Teflon), vinyl, polypropylene (PP), polyvinyl chloride (PVC), polyvinylidene difluoride (PVDF), stainless steel, suitable dielectric materials, other suitable materials, or a combination thereof. Both the positive electrode 61 and the negative electrode 62 are separated and electrically isolated from the plating solution during an electroless plating process.

The positive electrode 61 and the negative electrode 62 are configured to provide an electric field E1 vertically across the chamber 11. It should be noted that arrows in FIG. 18 indicating the magnetic field B1 and the electric field E1 are for a purpose of illustration and are not intended to indicate coverages or strengths of the fields B1 and E1, even though sizes of the arrows in FIG. 18 may be different from sizes of arrows in other figures. A coverage or a strength of the magnetic field B1 or the electric field E1 are determined by the first magnetic field generator 52 of the vibration modules 20 or by the bias applied to the electrodes 61 and 62. In some embodiments, the positive electrode 61 is electrically connected to a power source 13 and the negative electrode 62 is connected to ground. A combination of the magnetic field B1 and the electric field E1 results in spiral movements of ions in the plating solution to facilitate the electroless plating process and increase the deposition speed. In addition, interaction of the magnetic and electric fields also results in an upward spiral movement of anions in the plating solution. Therefore, the plating apparatus 204 of the present invention can further improve plating efficiency by facilitating separation of the cations and the anions in the plating solution even in an absence of a separator 70.

Figure 19:
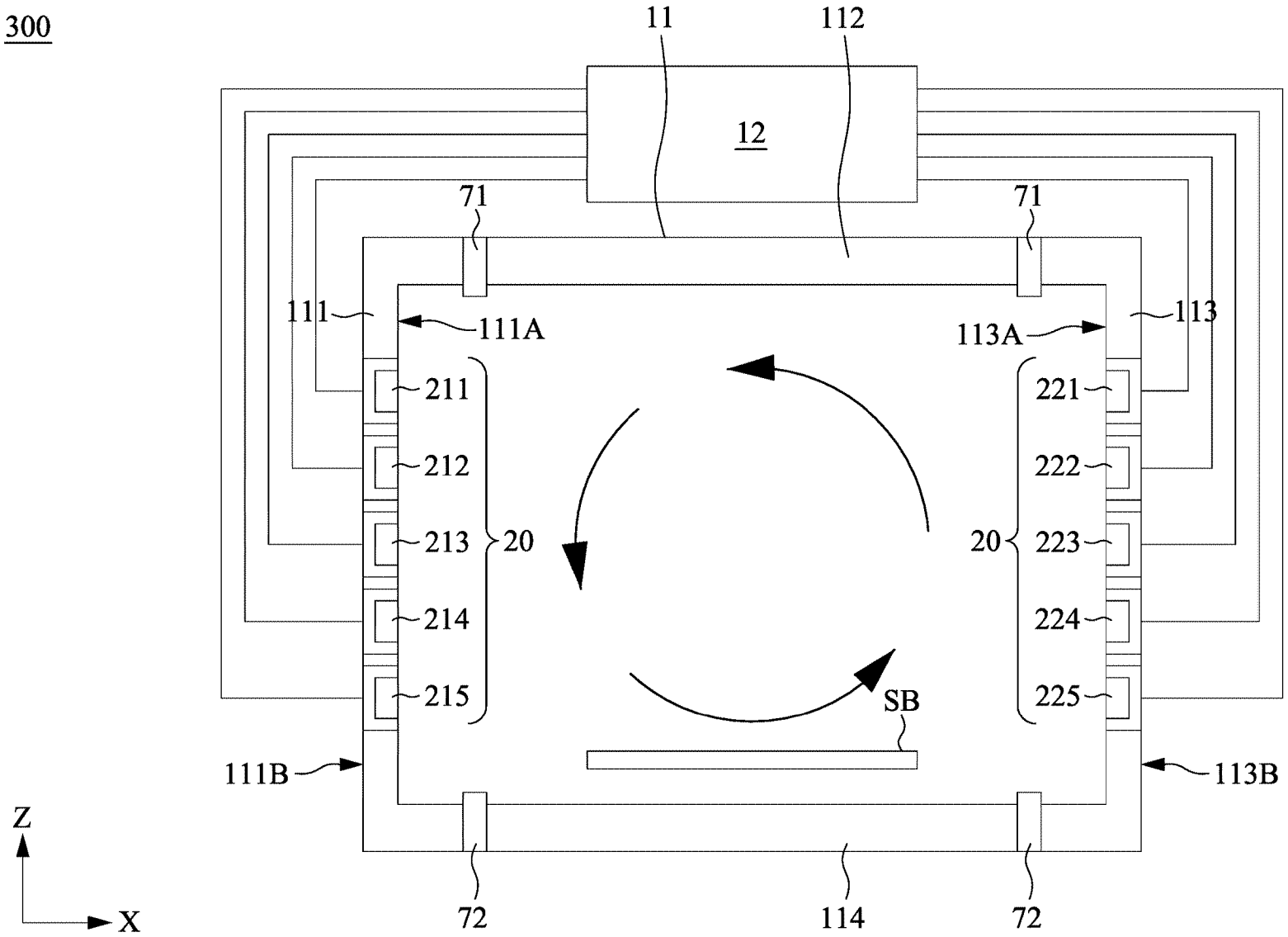

Referring to FIG. 19, FIG. 19 is a schematic diagram of a plating apparatus 300 in accordance with some embodiments of the present disclosure. The plating apparatus 300 can be similar to one of the plating apparatuses 201, 202, 203 and 204 but further includes a current phase controller 12. For a purpose of illustration, the following description refer to the same numeral labels in the plating apparatus 201 as previously addressed in FIG. 15.

The current phase controller 12 is configured to control the phase of the current that enters the conductive coil of each of the vibration modules 20, for a providing more versatile control of the movement of charged (positive or negative) reacting agents in the plating solution. In some embodiments, a conductive coil of each of devices of a vibration module 20 is electrically connected to the current phase controller 12. Different conductive coils are simultaneously provided with current having different phases in order to exert different directions of forces F on charged reacting agents locally (e.g., in proximity to the conductive coils with designated phase). Each of devices 211, 212, 213, 214 and 215 can be similar to one of the devices 500, 501, 502, 503 and 504 as long as they have a consistent direction of magnetic fields. Similarly, each of the devices 221, 222, 223, 224 and 225 can be similar to one of the devices 500, 501, 502, 503 and 504 as long as they have a consistent direction of magnetic fields.

In some embodiments, the currents with different phases are entered into the conductive coils of the devices 211 to 215 and 221 to 225. Different current phase angles with constant intervals can be applied to adjacent conductive coils arranged in a counterclockwise or clockwise direction. For example, adjacent conductive coils arranged in the counterclockwise direction have a constant intervals of current phase differences set by the current phase controller 12. In some embodiments, the constant interval of current phase angles assigned to adjacent conductive coils arranged in the counterclockwise direction can be positive or negative, so that the current phase angles can be increased or decreased among the adjacent conductive coils so arranged. A resulting force exerted on charged reacting agents guiding a macroscopic flow of the charged reacting agents in a counterclockwise direction, as shown by curved arrows in FIG. 19.

For instance, as shown in Table 2 below, the device 225 is provided with a current having a phase angle of 0 (or 360) degrees; the device 224 is provided with a current having a phase angle of 36°; the device 223 is provided with a current having a phase angle of 72°; the device 222 is provided with a current having a phase angle of 108°; the device 221 is provided with a current having a phase angle of 144°; the device 211 is provided with a current having a phase angle of 180°; the device 212 is provided with a current having a phase angle of 216°; the device 213 is provided with a current having a phase angle of 252°; the device 214 is provided with a current having a phase angle of 288°; and the device 215 is provided with a current having a phase angle of 324°. Phases of different resulting forces corresponding to different conductive coils of the devices 211 to 215 and 221 to 225 are also provided in Table 2. A combination of all the resulting forces leads to a counterclockwise movement of the plating solution and thus the charged reacting agents therein.

TABLE 2

| Conductive Coil | Current Phase (Degrees) | Phase of Resulting Force (Degrees) |
|---|---|---|
| 225 | 0 or 360 | (0 + 36)/2 = 18 |
| 224 | 36 | (36 + 72)/2 = 54 |
| 223 | 72 | (72 + 108)/2 = 90 |
| 222 | 108 | (144 + 108)/2 = 126 |
| 221 | 144 | (144 + 180)/2 = 162 |
| 211 | 180 | (180 + 216)/2 = 198 |
| 212 | 216 | (216 + 252)/2 = 234 |
| 213 | 252 | (252 + 288)/2 = 270 |
| 214 | 288 | (288 + 324)/2 = 306 |
| 215 | 324 | (324 + 360)/2 = 342 |

The schematic diagram of FIG. 19 shows positions of the vibration modules 20 relative to the chamber 11 from a side-view perspective. The vibration modules 20 may include a greater number of devices as seen in a view facing the sidewall 111 or the sidewall 113.

Figure 20:
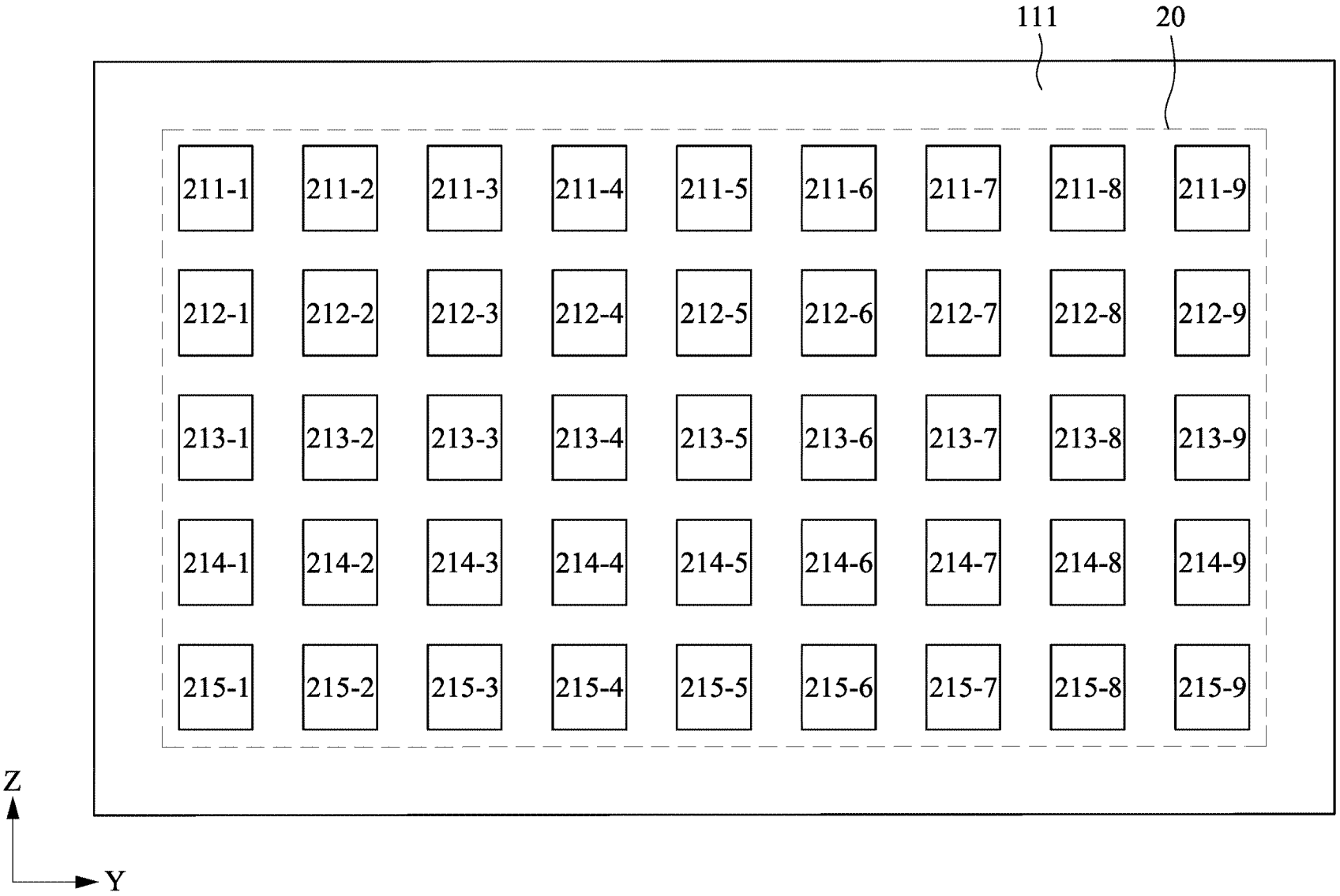
FIG. 20 is a schematic view showing an arrangement of vibration modules on a plating apparatus in accordance with some embodiments of the present disclosure.

Referring to FIG. 20, FIG. 20 is a schematic cross-sectional diagram showing an arrangement of the vibration module 20 facing the sidewall 111 of the apparatus 300 in accordance with some embodiments of the present disclosure. The vibration module 20 may include multiple devices arranged in an array. In some embodiments, the vibration module 20 includes 9 devices (211-1 to 211-9, 212-1 to 212-9, 213-1 to 213-9, 214-1 to 214-9, or 215-1 to 215-9) in a row extending along a Y direction over the sidewall 111 in FIG. 20. The devices 211, 212, 213, 214 and 215 shown in FIG. 19 can be the devices 211-1, 212-1, 213-1, 214-1 and 215-1 shown in FIG. 20 respectively. For ease of illustration, the numbers before the symbol "-" (i.e., 211, 212, 213, 214 and 215) represent different rows of devices arranged along the Z direction, and the numbers after the symbol "-" (i.e., 1, 2, 3, 4, 5, 6, 7, 8 and 9) represent different devices in a row extending along the Y direction. In other words, the vibration module 20 includes 45 devices on the sidewall 111 of the chamber 11.

The current phase controller 12 can be applied to the embodiments shown in FIG. 20 to facilitate a clockwise or counterclockwise movement of the plating solution and the charged reacting agents therein.

Figure 21:
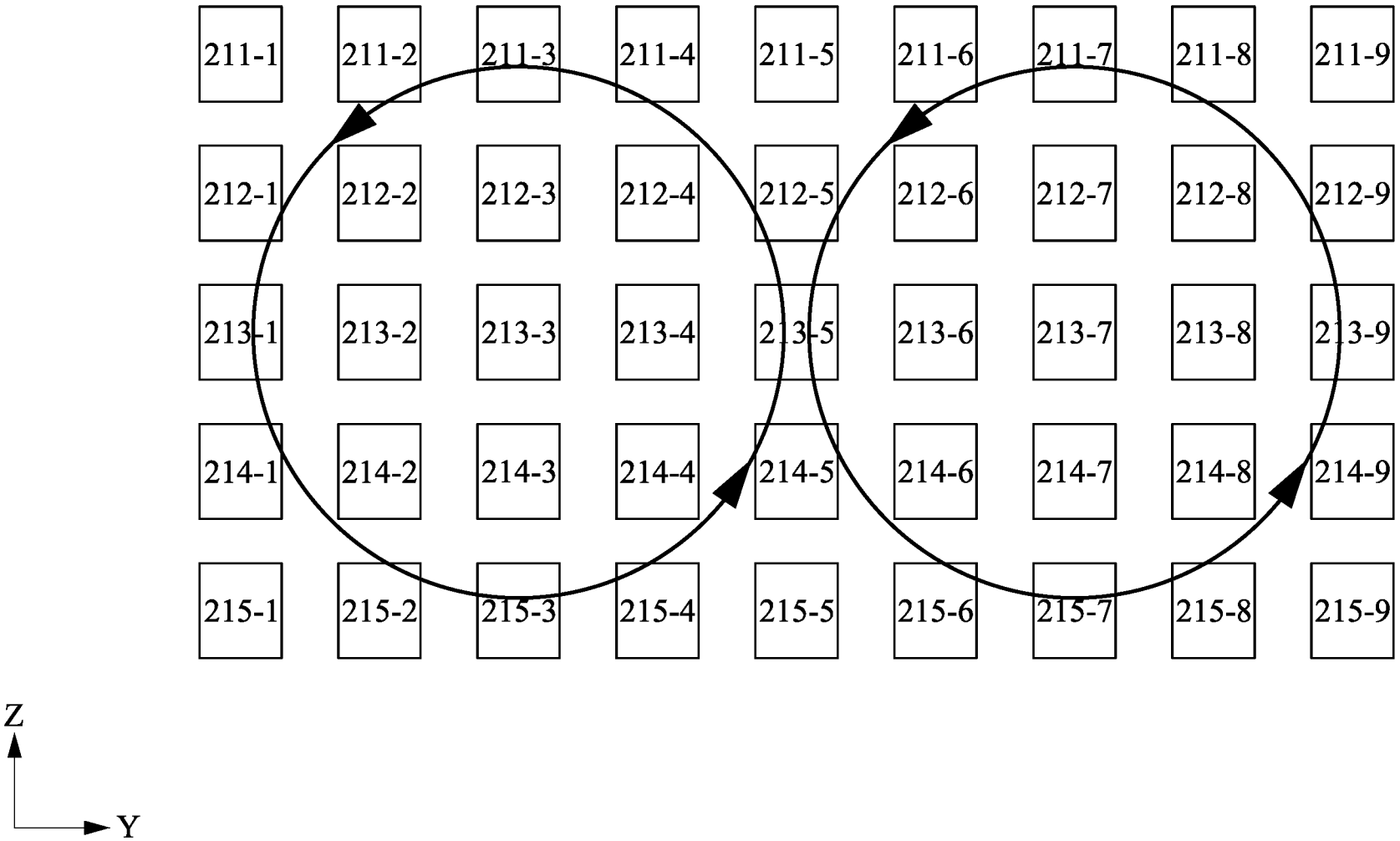
FIG. 21 is a schematic diagram showing forces generated by the vibration modules on the plating apparatus in accordance with some embodiments of the present disclosure.

Referring to FIG. 21, FIG. 21 is a schematic diagram showing a direction of the resulting forces caused by the devices. In some embodiments, each of the 45 devices in FIG. 20 is electrically connected to the current phase controller 12 shown in FIG. 19. Currents with different phases are entered into the devices of the vibration module 20 as described previously, and a desired swirling direction of the plating solution can be provided. A pattern of spiral movement of the plating solution can be adjusted or controlled by the current phase controller 12.

In some embodiments, electrical connections to the devices 211-5, 212-5, 213-5, 214-5 and 215-5 are turned off, and other devices in FIG. 21 are provided with currents having different phases according to concepts described above. The resulting forces indicated by curved arrows in FIG. 21 can thereby be generated, and combinations of the resulting forces result in swirling of the plating solution in two counterclockwise circles when facing an interior surface 111A of the sidewall 111. It should be noted that the resulting forces shown in FIG. 21 are for a purpose of illustration. A direction or a pattern of the resulting forces can be adjusted according to different applications and different designs.

According to the inventive concept as described above, the present disclosure further provides embodiments of plating apparatuses and devices in following description.

Figure 22:
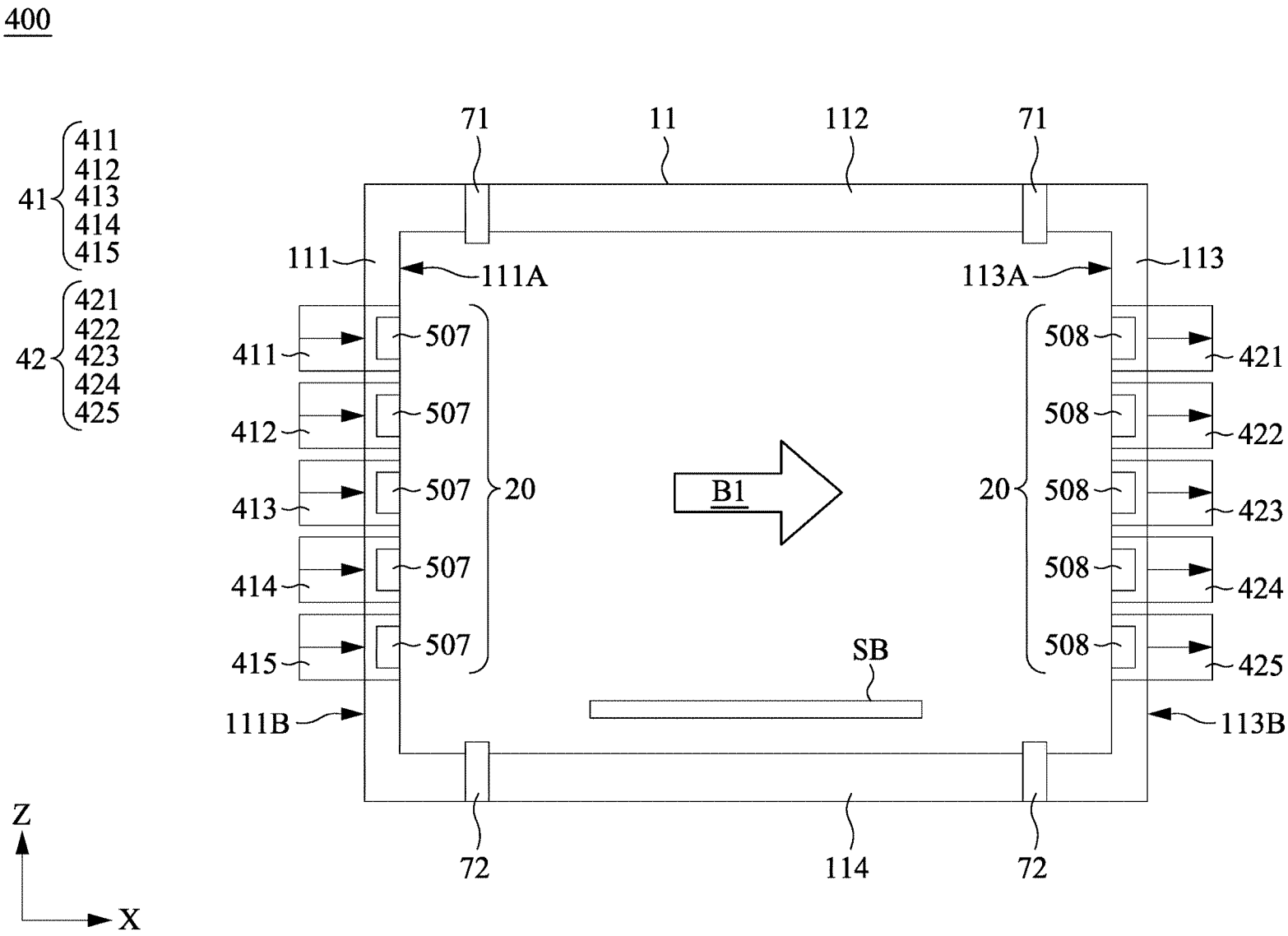
FIG. 22 is a schematic diagram of a plating apparatus in accordance with some embodiments of the present disclosure.

Referring to FIG. 22, FIG. 22 is a schematic side-view of a plating apparatus 400 in accordance with some embodiments of the present disclosure. The plating apparatus 400 can be an electroless plating apparatus similar to the plating apparatus 201 but without first magnetic field generators in the frame of each device 507 or 508.

A vibration module 20 of the plating apparatus 400 includes a plurality of devices 507 or 508. In some embodiments, the vibration module 20 on the sidewall 111 is mirrored to or symmetrical to the vibration module 20 on the sidewall 113. The device 507 or 508 can be similar to the device 500, 501, 502, 503 or 504 without the first magnetic field generator 52 shown in FIG. 2, 6, 8, 11 or 13. In order to provide a magnetic field B1 laterally across a chamber 11 of the plating apparatus 400 along the X direction, one or more magnetic field generators 41 or 42 can be attached to the sidewall 111 or 113 of the chamber 11, which is proximal to bottoms of the frames of each of the devices 507 and 508.

In some embodiments, the plating apparatus 400 includes a third magnetic field generator 41 disposed on a sidewall 111 of the chamber 11. In some embodiments, the third magnetic field generator 41 is disposed over an exterior surface 111B of the sidewall 111 of the chamber 11 and proximal to exterior bottom surfaces of the frames of the devices 507. In some embodiments, the third magnetic field generator 41 includes multiple magnets 411, 412, 413, 414 and 415. In some embodiments, each of the magnets 411, 412, 413, 414 and 415 is aligned with one of the devices 507 along a horizontal direction of FIG. 22. In some embodiments, each of the magnets 411, 412, 413, 414 and 415 is fixed on the chamber 11 by silicone. In some embodiments, the each of the magnets 411, 412, 413, 414 and 415 is fixed on the chamber 11 by stakes, nails, screws, rivets, other suitable fasteners, or a combination thereof (not shown). The plating apparatus 400 may further include a fourth magnetic field generator 42 disposed on a sidewall 113 of the chamber 11. In some embodiments, the fourth magnetic field generator 42 includes magnets 421, 422, 423, 424 and 425. An arrangement of the magnets 421, 422, 423, 424 and 425 can be similar to an arrangement of the magnets 411, 412, 413, 414 and 415, and repeated description is omitted herein.

In order to provide the magnetic field B1 having a direction from the sidewall 111 toward the sidewall 113, all of the magnetic field generators 41 and 42 outside of the devices 507 or 508 are having a same polarity and oriented in a same direction (e.g., S to the left and N to the right), so that the magnetic field B1 has a direction from the sidewall 111 toward the sidewall 113 of the chamber 11, as depicted in FIG. 22. In some other embodiments, all of the magnetic field generators outside of the devices 507 or 508 are having a same polarity and oriented in a same direction (e.g., N to the left and S to the right), so that the magnetic field has a direction from the sidewall 113 toward the sidewall 111 of the chamber 11 (not illustrated in FIG. 22). It should be noted that, the devices 507 and any of the magnets 411, 412, 413, 414, 415 combinedly form a local magnetic field substantially the same as those depicted in FIG. 4, while the devices 508 and any of the magnets 421, 422, 423, 424, 425 combinedly form a local magnetic field substantially the same as those depicted in FIG. 13. In such arrangement, not only the local magnetic fields B21 and B22 can be built up locally at each of the device level, but also the macroscopic magnetic field B1 can be built up laterally across the chamber 11.

A purpose of replacement of the first magnetic field generator 52 by the third magnetic field generator 41 and the fourth magnetic field generator 42 is for maintenance convenience. In addition, the presence of the third magnetic field generator 41 and the fourth magnetic field generator 42 outside of the chamber 11 can have an advantage of ease of adjustment of a strength of the magnetic field B1. As illustrated above, a spiral movement of the reacting agents and vibrations of the films of the vibration module 20 may be affected by the magnetic field B1. For instance, a radius of gyration of the reacting agents and an amplitude of a film of a device 507 or 508 can be adjusted by controlling the strength of the magnetic field B1. The embodiments shown in FIG. 22 provides a flexibility in terms of controlling the strength of the magnetic field B1 and the local magnetic field causing the flexible film 54 to vibrate in accordance with different deposition operations performed in the chamber 11.

According to the Lorentz force equation (I) previously described, along with the agitation to the plating solution caused by the vibration modules 20, force F experienced by charged (positive or negative) ions/reacting agents in the plating solution can be generated due to the presence of the magnetic field B1, causing a spiral trajectories of the charged ions/reacting agents to reach the plating surface of the workpiece SB. These spiral trajectories increase the possibilities of the charged ions/reacting agents to collide with the kinks, or the sites combines with which lowers the total Gibbs free energy, and thereby facilitate the production efficiency and uniformity of the plated film.

The magnetic field generators 41 and 42 may be disposed outside or inside the sidewall 111 or 113 of the chamber 11. In some embodiments, the magnetic field generator 41 or 42 can be attached to an exterior bottom surface of the frame of each of the devices 507 or 508.

It should be noted that the third magnetic field generator 41 or the fourth magnetic field generator 42 can include a different number of magnets as long as a same purpose as described above can be achieved. In some embodiments, the third magnetic field generator 41 includes one big magnet laterally overlapping all the devices 507. In addition, the third magnetic field generator 41 or the fourth magnetic field generator 42 can be applied as the first magnetic field generators 52. The third magnetic field generator 41 and the fourth magnetic field generator 42 in such case are for a purpose of enhancing the magnetic field B1 and ease of adjustment of the strength of the magnetic field B1 and maintenance of the magnets 411 to 415 and 421 to 425 externally.

Figure 23:
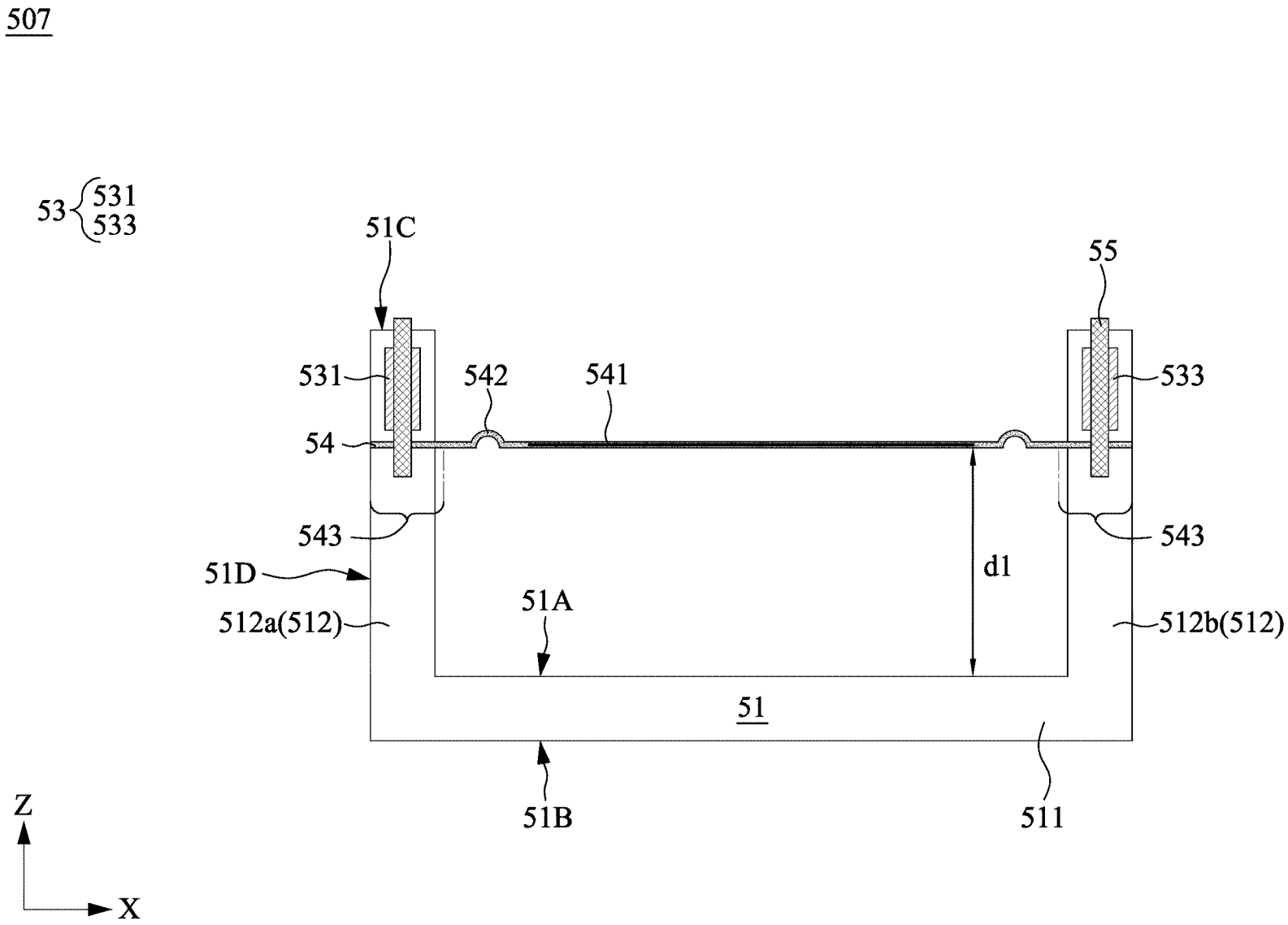
FIG. 23 is a schematic cross-sectional diagram of modules in accordance with some embodiments of the present disclosure.

FIG. 23 is a schematic cross-sectional diagram of the device 507 of the plating apparatus 400 in accordance with some embodiments of the present disclosure. The device 507 may be similar to the device 500, but is free of the first magnetic field generator 52 shown in FIG. 2. As previously described, the magnets 411, 412, 413, 414, 415 serve the purpose of the first magnetic field generator 52, which in combination with the second magnetic field generators 53 to form a magnetic field at one end, perpendicular to the bottom of the frame 51 at the vicinity of the magnets 411, 412, 413, 414, 415, and at the other end, substantially parallel to the plane of the flexible film 54 at the vicinity of the magnets 531 and 533 of the second magnetic field generator 53.

Figure 24:
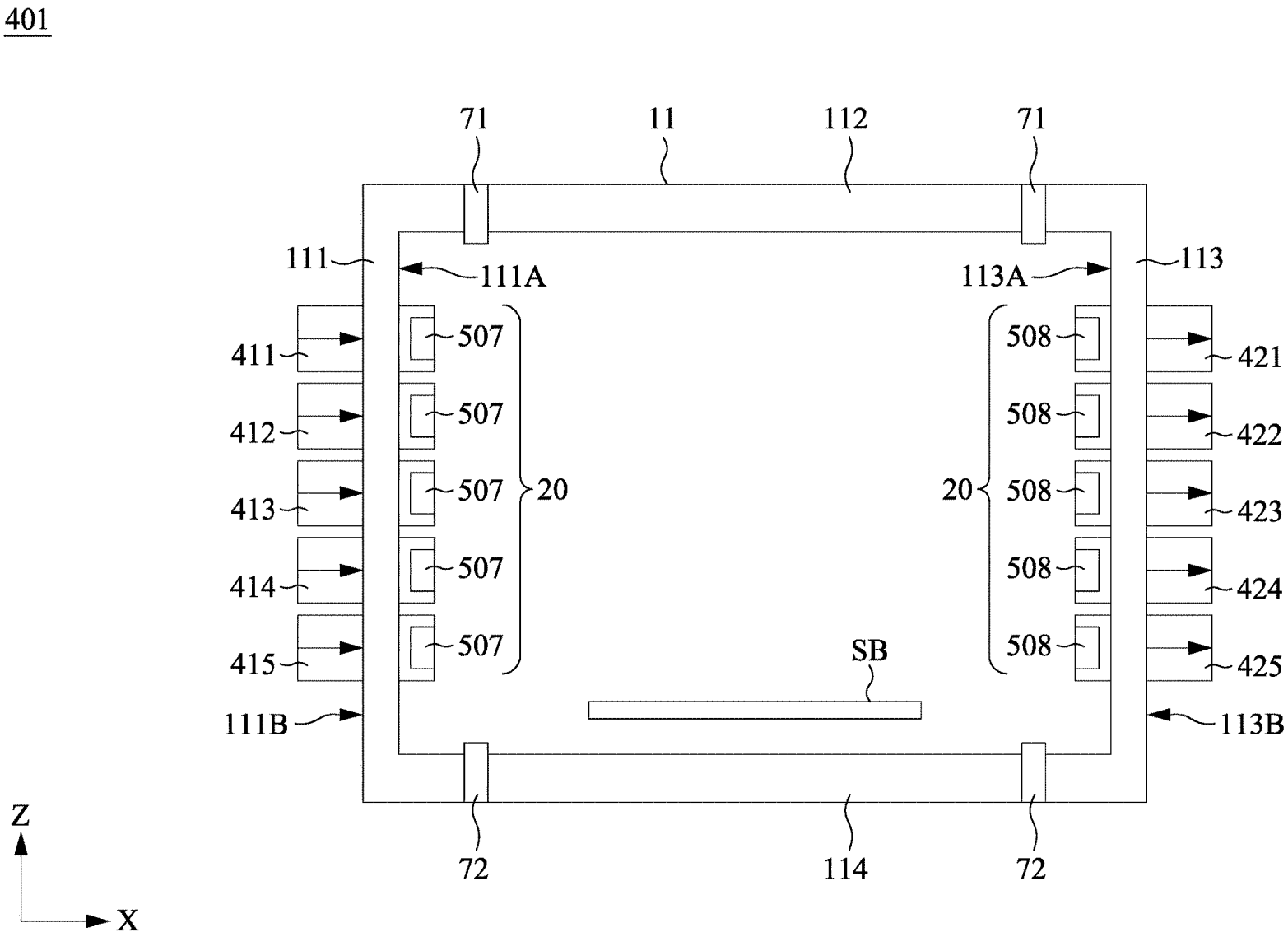
FIG. 24 is a schematic diagram of a plating apparatus in accordance with some embodiments of the present disclosure.

Referring to FIG. 24, FIG. 24 is a schematic side-view of a plating apparatus 401 in accordance with some embodiments of the present disclosure. The device 507 and 508 of the vibration module 20 and the magnets 411, 412, 413, 414, 415, 421, 422, 423, 424, 425 are substantially the same as those described in FIG. 22 except that the vibration module 20 can be disposed on interior surfaces 111A and 113A of the sidewalls 111 and 113, as previously described and illustrated in FIG. 16, while the magnets 411, 412, 413, 414, 415, 421, 422, 423, 424, 425 serving the purpose of the first magnetic field generator are still attached to the exterior surfaces 111B and 113B of the chamber 11. Although not illustrated in the present disclosure, people having ordinary skill in the art may appreciate that, in some embodiments, the plating apparatus not only include any of the devices 501, 502, 503, 504, but also the additional magnetic fields generator, such as the magnets 411, 412, 413, 414, 415, 421, 422, 423, 424, 425 outside of the devices 501, 502, 503, 504 and affixed to the plating apparatus in order to build up both the local magnetic fields B21 and B22 and the macroscopic magnetic field B1 laterally across the chamber 11 of the plating apparatus.

Figure 25:
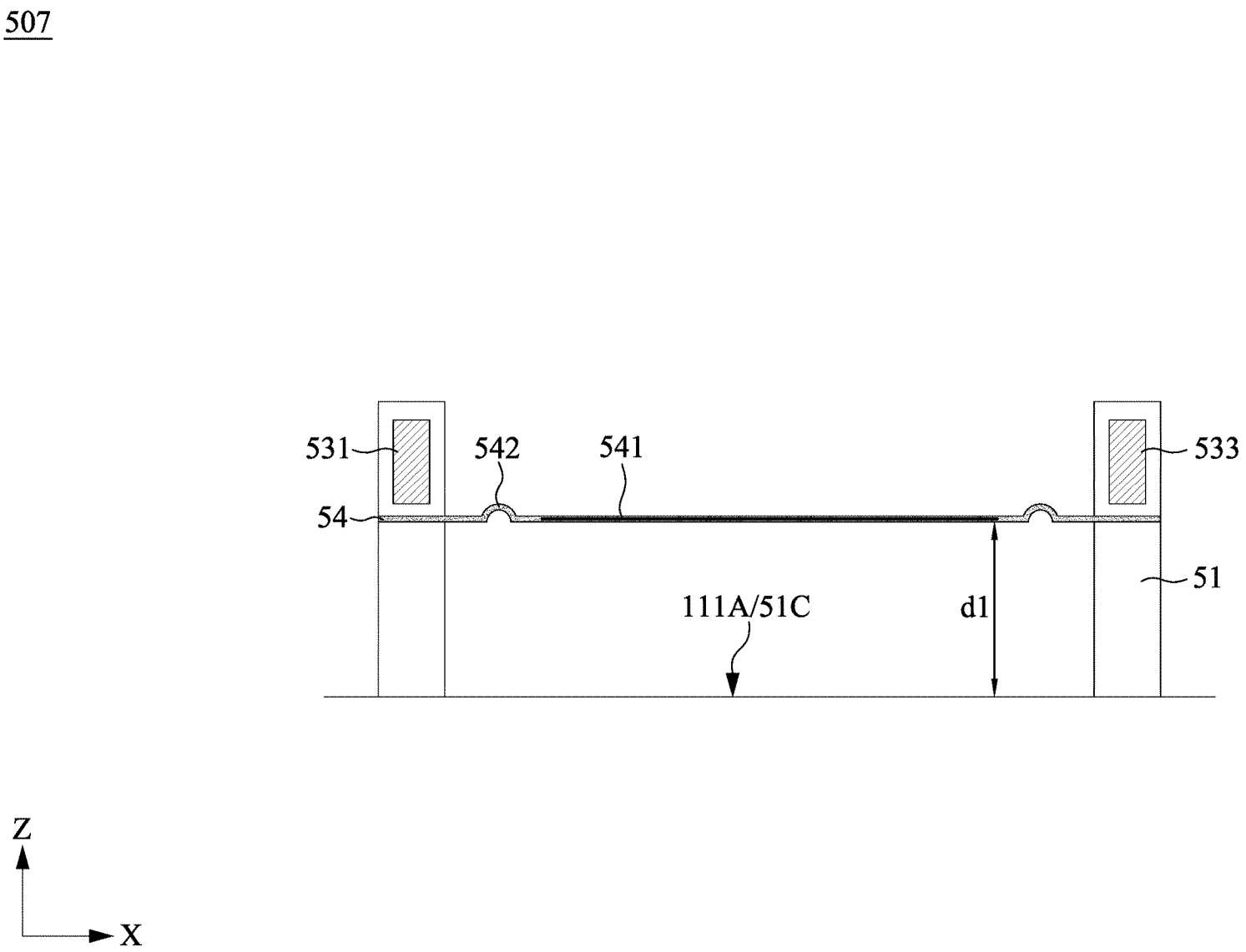
FIG. 25 is a schematic cross-sectional diagram of vibration modules in accordance with different embodiments of the present disclosure.

Referring to FIG. 25, FIG. 25 is a schematic cross-sectional diagram of the device 507 of the plating apparatus 401 in accordance with some embodiments of the present disclosure. For a purpose of minimizing a thickness of the device 507, the bottom 511 of the frame 51 shown in FIG. 23 is removed. In some embodiments, a frame 51 of the device 507 shown in FIG. 25 is a ring-shaped structure from a top view. In some embodiments, the ring-shaped frame 51 shown in FIG. 25 is attached to the interior surface 111A of the sidewall 111. In some embodiments, a distance d1 between the flexible film 54 and the interior surface 111A defines a height of a resonant cavity of the device 507. In some embodiments, a portion of the interior surface 111A is considered as a bottom surface 51C of the frame 51. In some embodiments, at least the portion of the interior surface 111A is magnetically conductive.

Figure 26:
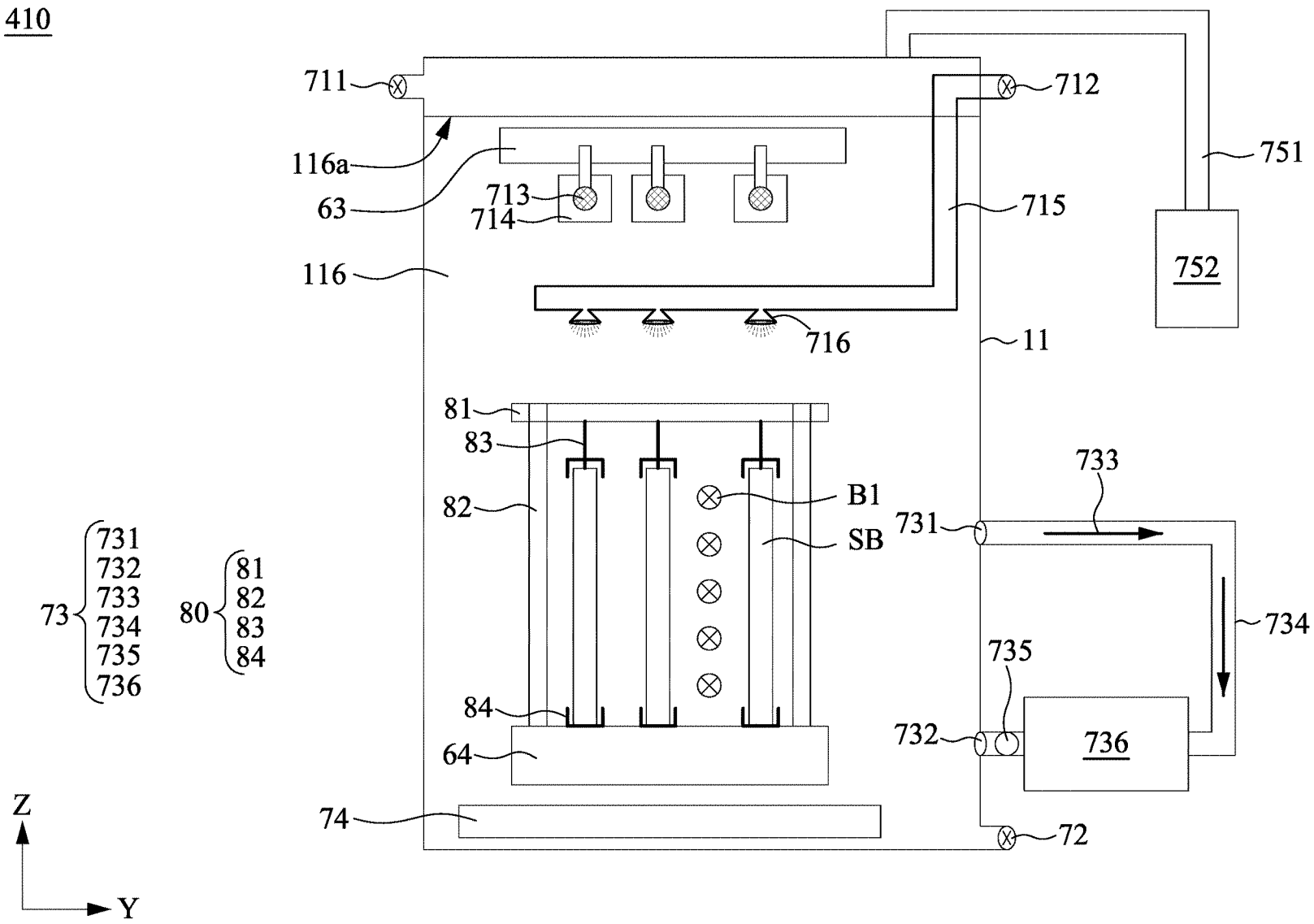
FIG. 26 is a schematic diagram of a plating apparatus in accordance with some embodiments of the present disclosure.

Referring to FIG. 26, FIG. 26 is a schematic cross-sectional diagram of a plating apparatus 410 in accordance with some embodiments of the present disclosure. In some embodiments, a plating solution or chemicals for a plating operation are provided in a chamber 11 through one or more openings in sidewalls of the chamber 11. In some embodiments, one or more liquid chemicals (e.g., copper-containing solution, phosphorus-containing solution, sulfuric acid, or other plating solutions) are provided to the chamber 11 through an opening 711. In some embodiments, one or more gaseous chemicals (e.g., phosphine) are injected through an opening 712. In some embodiments, the plating apparatus 410 further include a conduit 715 extending inside the chamber 11 from the opening 712, wherein a free end of the conduit 715 is designed to be below a top surface 116*a* of a plating solution 116 during the plating operation. In some embodiments, multiple diffusion structures 716 are disposed proximal to the free end of the conduit 715 for a purpose of facilitating diffusion of the gaseous chemicals in the plating solution. In some embodiments, a configuration of a diffusion structure 716 may be similar to that of a showerhead.

A positive electrode 63 of the plating apparatus 410 can be partially or entirely within the plating solution during the plating operation. An anode 713 can be disposed proximal to the positive electrode 63. In some embodiments, the anode 713 is connected to the positive electrode 63. At least a portion of the anode 713 should be within the plating solution during the plating operation. In some embodiments, the anode 713 is disposed below the positive electrode 63, and an entirety of the anode 713 is within the plating solution. In some embodiments, the anode 713 is a phosphorized copper anode ball (which may include phosphorus in a concentration between about 0.03% and 0.08%). In some embodiments, the anode 713 is a micro-grain copper anode ball. In some embodiments, the anode 713 is enclosed in or sealed by an anode bag 714. In some embodiments, the anode bag 714 includes a Dynel material, polypropylene, or a combination thereof for a purpose of filtration. In some embodiments, the anode bag 714 is a titanium basket for a purpose of holding the anode 713. In some embodiments, a portion of the conduit 715 extends below the positive electrode 63 and the anode 713. In some embodiments, the diffusion structures 716 are disposed on the portion of the conduit 715. A negative electrode 64 is disposed in the chamber 11 opposite to the positive electrode 63. For instance, the positive electrode 63 is disposed in proximity to a top (or an upper sidewall) of the chamber 11 and apart from the negative electrode 64, wherein the negative electrode 64 is disposed in proximity to a bottom (or a lower sidewall) of the chamber 11. In some embodiments, the negative electrode 64 functions as a cathode in the plating operation. An electric field (not shown in FIG. 15) is generated by the positive electrode 63 and the negative electrode 64 during an electroplating operation. The plating apparatus 410 may further include a heater 84 disposed in the chamber 11 and proximal to the bottom of the chamber. In some embodiments, the heater 74 is disposed between the lower sidewall of the chamber 11 and the negative electrode 64. In some embodiments, a temperature of the heater 74 is controlled in a range of 50 to 60 degrees Celsius during the plating operation.

The plating apparatus 410 may further include a supporting structure 80 configured to hold multiple workpieces SB in the chamber 11. In some embodiments, the supporting structure 80 includes one or more beams 81 held or supported by multiple columns 82. In some embodiments, multiple upper clamp structures 83 are connected to the multiple beams 81, respectively, for holding the multiple workpieces SB. In some embodiments, each of the workpieces SB is disposed vertically over the negative electrode 64 between the columns 82. In some embodiments, the workpieces SB are substantially parallel to one another during the plating operation. In some embodiments, each of the upper clamp structures 83 holds a first peripheral portion of each of the workpieces SB. In some embodiments, the supporting structure 80 further includes multiple lower holding members 84. In some embodiments, each of the lower holding members 84 is vertically aligned with each of the upper clamp structures 83. In some embodiments, each of the lower holding members 84 holds a second peripheral portion opposite to the first peripheral portion of one of the workpieces SB. The supporting structure 80 can achieve formation of thin films on multiple workpieces SB concurrently by one plating operation. In some embodiments, components of the supporting structure 80 (e.g., the beams 81, the columns 82, the upper clamp structures 83 and the lower holding members 84) may be made of copper or copper alloy. In some embodiments, the upper clamp structures 83 and the lower holding members 84 are coated with a dielectric material, such as plastisol or koroseal. It should be noted that the supporting structure 80 can be applied in other embodiments (e.g., plating apparatus 201, 202, 203, 204, 300, 400 or 401) as illustrated above, and the present disclosure is not limited to a certain embodiment shown in one of the figures.

The plating apparatus 410 may further include a filtration system 73. The filtration system 73 is for purposes of impurity filtration and metallic ion precipitation for a better plating result. In some embodiments, the filtration system 73 includes a conduit 734, a filter 735 and a pump 736. In some embodiments, the conduit 734 provides fluid communication with the chamber through openings 731 and 732. In some embodiments, the filter 735 is disposed in and across a cross section of the conduit 734 in order to filter the plating solution passing there through. Under an operation of the pump 736, the plating solution is drawn out from the chamber 11 through the opening 731 and flows into the conduit 734, passes through the filter 735, and then returns to the chamber 11 through the opening 732. In some embodiments, an entirety of the plating solution is filtered one to three times per hour by the pump 736. In some embodiments, the filter 735 may have a membrane aperture of 1.3 microns or 5 microns.

In some embodiments, the plating apparatus 410 may further include an exhaust conduit 751 connected to a local scrubber 752 for exhaust of gaseous compounds, e.g., hydrogen, chlorine, fluorine or other gases produced during the plating operation. The local scrubber 752 can be a thermal scrubber, a wet scrubber, a thermal-wet scrubber, a burn scrubber, a dry scrubber, a catalyst scrubber, or a plasma scrubber. Any suitable type of scrubber can be used, and is not limited herein.

As described above, the plating apparatus 410 should include at least a magnetic field generator 41 or 42, as previously described in FIG. 22, on a sidewall (or sidewalls) of the chamber 11. In some embodiments as illustrated in FIG. 26, a magnetic field B1 is provided by the magnetic field generator 41 or 42 in a direction inward, toward the paper, i.e., from the viewer. Therefore, formation of multiple thin films on multiple workpieces SB respectively can be achieved, and a conformity and an efficiency of a plating operation can be improved by a combination of the electric field and the magnetic field B1.

Therefore, the present disclosure provides a device for assisting agitation of a liquid or a solution in a chamber and an apparatus including the same. It should be noted that the above embodiments and description focuses on a deposition operation and a deposition apparatus for as an exemplary illustration for a purpose of ease of understanding. However, the concept and the device of the present invention can be applied in other types of apparatus, such as a wafer cleaning apparatus in semiconductor manufacturing industry or general household applications such as a dishwasher or a laundry machine, to assist or facilitate agitation of water or solution. The present invention is not limited to the embodiments illustrated in the disclosure.

Some embodiments of the present disclosure provide a device for assisting in liquid phase deposition. The device includes a frame having a bottom and a sidewall forming an angle with the bottom; a first flexible film attached to the frame at a periphery portion of the first flexible film; a first magnetic field generator at the sidewall of the frame and adjacent to the periphery portion of the first flexible film; and a second magnetic field generator at the bottom of the frame, wherein the first magnetic field generator and the second magnetic field generator are configured to provide a magnetic field parallel to at least a portion of the first flexible film, and wherein the first flexible film are configured to be in contact with a solution for liquid phase deposition.

Some embodiments of the present disclosure provide an apparatus for liquid phase thin-film deposition. The apparatus includes a chamber and a vibration module. The chamber configured to accommodate a solution for liquid phase deposition; and a vibration module adjacent to a sidewall of the chamber and in contact with the solution for liquid phase deposition. The vibration module includes: a frame having a bottom and a sidewall forming an angle with the bottom surface; a first flexible film attached to the frame at a periphery portion of the first flexible film; and a first magnetic field generator at the sidewall of the frame and adjacent to the periphery portion of the first flexible film. The apparatus further includes a second magnetic field generator adjacent to the sidewall of the chamber, wherein the first magnetic field generator and the second magnetic field generator are configured to provide a first magnetic field parallel to at least a portion of the first flexible film.

The foregoing outlines features of several embodiments so that those skilled in the art may better understand the aspects of the present disclosure. Those skilled in the art should appreciate that they may readily use the present disclosure as a basis for designing or modifying other operations and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein, may be utilized according to the present invention. Accordingly, the appended claims are intended to include within their scope such processes, machines, manufacture, compositions of matter, means, methods, and steps.

What is claimed:

1. A device for assisting agitation of liquid, comprising:

a frame having a bottom and a sidewall forming an angle with the bottom;

a first flexible film attached to the frame at a periphery portion of the first flexible film;

a first magnetic field generator at the sidewall of the frame and adjacent to the periphery portion of the first flexible film; and a second magnetic field generator proximal to the bottom of the frame, wherein the first magnetic field generator and the second magnetic field generator are configured to provide a magnetic field parallel to at least a portion of the first flexible film, and wherein the first flexible film is configured to be in contact with the liquid.

2. The device of claim 1, further comprising a first conductive coil in connection with the first flexible film, the first conductive coil forming a spiral with respect to a coil axis orthogonal to the bottom of the frame.

3. The device of claim 2, wherein the first conductive coil comprises two terminals for conducting current, and an interaction between the current and the magnetic field parallel to at least a portion of the first flexible film causes the first conductive coil and the first flexible film to vibrate.

4. The device of claim 3, wherein the current is an alternating current or a direct current.

5. The device of claim 1, wherein the first magnetic field generator includes multiple magnets surrounding the first flexible film.

6. The device of claim 1, wherein at least one of the first magnetic field generator and the second magnetic field generator is a ring-shaped magnet.

7. The device of claim 1, further comprising a second flexible film attached to the frame at a periphery portion of the second flexible film, and the first flexible film being arranged between the second flexible film and the bottom of the frame.

8. The device of claim 7, further comprising:

a third magnetic field generator at the sidewall of the frame and adjacent to the periphery portion of the second flexible film; and a fourth magnetic field generator between the first flexible film and the second flexible film.

9. The device of claim 8, wherein the fourth magnetic field generator is connected to the second magnetic field generator by a magnetically conductive material.

10. The device of claim 8, wherein the third magnetic field generator and the fourth magnetic field generator are configured to provide a magnetic field parallel to at least a portion of the second flexible film.

11. The device of claim 1, wherein the frame is composed of magnetically conductive material.

12. An apparatus for assisting agitation of liquid, comprising:

a chamber configured to accommodate the liquid; and a vibration module adjacent to a sidewall of the chamber and in contact with the liquid, wherein the vibration module comprises:

a frame having a bottom and a sidewall forming an angle with the bottom surface;

a first flexible film attached to the frame at a periphery portion of the first flexible film; and a first magnetic field generator at the sidewall of the frame and adjacent to the periphery portion of the first flexible film; and a second magnetic field generator proximal to the bottom of the frame, wherein the first magnetic field generator and the second magnetic field generator are configured to provide a first magnetic field parallel to at least a portion of the first flexible film.

13. The apparatus of claim 12, wherein the second magnetic field generator is at the bottom of the vibration module.

14. The apparatus of claim 12, wherein the second magnetic field generator comprises a plurality of magnets adjacent to the sidewall of the chamber and configured to provide a second magnetic field in a horizontal direction in the chamber.

15. The apparatus of claim 12, further comprising:

a pair of electrodes adjacent to an upper wall and a lower wall of the chamber and configured to provide an electric field in a vertical direction in the chamber.

16. The apparatus of claim 15, wherein the pair of electrodes is in contact with the liquid, and wherein the liquid is solution for liquid phase deposition.

17. The apparatus of claim 15, wherein the pair of electrodes comprises a first electrode enclosed in the upper wall of the chamber and a second electrode enclosed in the lower wall of the chamber.

18. The apparatus of claim 17, wherein the first electrode and the second electrode are enclosed in Teflon and are isolated from the liquid, wherein the liquid is solution for liquid phase deposition.

19. The apparatus of claim 12, further comprising a plurality of vibration modules adjacent to the sidewall of the chamber and arranged in an array.

20. The apparatus of claim 19, further comprising a current phase controller electrically connected to each of the vibration modules and configured to control a phase of current entering each of the vibration modules.

* * * * *